US011257665B2

(12) United States Patent
Jarrold et al.

(10) Patent No.: US 11,257,665 B2
(45) Date of Patent: Feb. 22, 2022

(54) INTERFACE FOR TRANSPORTING IONS FROM AN ATMOSPHERIC PRESSURE ENVIRONMENT TO A LOW PRESSURE ENVIRONMENT

(71) Applicant: THE TRUSTEES OF INDIANA UNIVERSITY, Bloomington, IN (US)

(72) Inventors: Martin F. Jarrold, Bloomington, IN (US); Staci N. Anthony, Grandview, OH (US); Benjamin E. Draper, Bloomington, IN (US)

(73) Assignee: The Trustees Of Indiana University, Bloomington, IN (US)

( * ) Notice: Subject to any disclaimer, the term of this patent is extended or adjusted under 35 U.S.C. 154(b) by 0 days.

(21) Appl. No.: 17/058,544

(22) PCT Filed: Jun. 4, 2019

(86) PCT No.: PCT/US2019/035379

§ 371 (c)(1),
(2) Date: Nov. 24, 2020

(87) PCT Pub. No.: WO2019/236572

PCT Pub. Date: Dec. 12, 2019

(65) Prior Publication Data

US 2021/0193447 A1 Jun. 24, 2021

Related U.S. Application Data

(63) Continuation-in-part of application No. PCT/US2019/013274, filed on Jan. 11, 2019.
(Continued)

(51) Int. Cl.
*H01J 49/06* (2006.01)
*H01J 49/02* (2006.01)
(Continued)

(52) U.S. Cl.
CPC ..... *H01J 49/066* (2013.01); *H01J 49/022* (2013.01); *H01J 49/025* (2013.01); *H01J 49/24* (2013.01); *H01J 49/425* (2013.01)

(58) Field of Classification Search
CPC ..... H01J 49/066; H01J 49/022; H01J 49/025; H01J 49/24; H01J 49/425
(Continued)

(56) References Cited

U.S. PATENT DOCUMENTS 3,019,168 A 1/1962 Taylor
5,285,063 A 2/1994 Schwartz et al.
(Continued)

FOREIGN PATENT DOCUMENTS

WO 1998011244 A1 3/1998
WO 1999061601 A1 12/1999
(Continued)

OTHER PUBLICATIONS

Draper et al., "The FUNPET—a New Hybrid Ion Funnel-Ion Carpet Atmospheric Pressure Interface for the Simultaneous Transmission of a Broad Mass Range", Journal of the American Society of Mass Spectrometry, pp. 2160-2172 (2018). (Year: 2018).*
(Continued)

*Primary Examiner* — Nicole M Ippolito
(74) *Attorney, Agent, or Firm* — Barnes & Thornburg, LLP

(57) ABSTRACT

An interface transports ions from a first pressure environment to a lower pressure analysis instrument and may include a first region pumped to a second pressure less than the first pressure, a first ion funnel disposed in the first region, a first ion carpet in the first region opposite an ion outlet end of the first ion funnel, a second region pumped to a third pressure less than the second pressure and greater than the instrument pressure, a second ion funnel disposed
(Continued)

in the second region and a second ion carpet in the second region opposite an ion outlet end of the second ion funnel. Ions from the environment pass sequentially through the first and second ion funnels and into the analysis instrument. Each of the first and second ion funnels define a tapered axial passageway therethrough each defining a respective virtual jet disrupter therein.

20 Claims, 12 Drawing Sheets

Related U.S. Application Data

(60) Provisional application No. 62/680,223, filed on Jun. 4, 2018.

(51) Int. Cl.
*H01J 49/42* (2006.01)
*H01J 49/24* (2006.01)

(58) Field of Classification Search
USPC ..... 250/281, 282, 283, 288
See application file for complete search history.

(56) References Cited

U.S. PATENT DOCUMENTS

| | | | |
|---|---|---|---|
| 5,478,745 | A | 12/1995 | Samulski |
| 5,572,025 | A | 11/1996 | Cotter |
| 5,770,857 | A | 6/1998 | Fuerstenau et al. |
| 5,863,541 | A | 1/1999 | Samulski et al. |
| 5,869,248 | A | 2/1999 | Yuan et al. |
| 5,877,022 | A | 3/1999 | Stinchcomb et al. |
| 5,880,466 | A | 3/1999 | Benner |
| 5,882,652 | A | 3/1999 | Valdes et al. |
| 5,886,346 | A | 3/1999 | Makarov |
| 5,905,040 | A | 5/1999 | Mazzara et al. |
| 5,916,563 | A | 6/1999 | Young et al. |
| 5,965,358 | A | 10/1999 | Carrion et al. |
| 6,013,487 | A | 1/2000 | Mitchell |
| 6,083,702 | A | 7/2000 | Mitchell et al. |
| 6,156,303 | A | 12/2000 | Russell et al. |
| 6,183,950 | B1 | 2/2001 | Madonna |
| 6,583,408 | B2 | 6/2003 | Smith et al. |
| 6,744,042 | B2 | 6/2004 | Zajfman et al. |
| 6,753,523 | B1 | 6/2004 | Whitehouse |
| 6,888,130 | B1 | 5/2005 | Gonin |
| 7,314,912 | B1 | 1/2008 | Hallek et al. |
| 7,829,842 | B2 | 11/2010 | Makarov |
| 8,294,085 | B2 | 10/2012 | Ding |
| 8,395,112 | B1 | 3/2013 | Bier |
| 8,409,870 | B2 | 4/2013 | Van Wujickhuijse |
| 9,095,793 | B2 | 8/2015 | Flagan |
| 10,056,244 | B1 * | 8/2018 | Quarmby ..... H01J 49/36 |
| 2003/0155502 | A1 | 8/2003 | Grosshans et al. |
| 2004/0169137 | A1 | 9/2004 | Westphall et al. |
| 2005/0236375 | A1 | 10/2005 | Gefter et al. |
| 2007/0254352 | A1 | 11/2007 | Schaffer et al. |
| 2009/0020694 | A1 | 1/2009 | Flory |
| 2009/0078866 | A1 | 3/2009 | Li et al. |
| 2010/0084549 | A1 | 4/2010 | Ermakov et al. |
| 2010/0084552 | A1 | 4/2010 | Kawana |
| 2010/0090102 | A1 | 4/2010 | Rather et al. |
| 2010/0227310 | A1 | 9/2010 | Manalis et al. |
| 2010/0234837 | A1 | 9/2010 | Alfano |
| 2010/0314538 | A1 | 12/2010 | Makarov et al. |
| 2010/0320377 | A1 | 12/2010 | Cotter |
| 2011/0095175 | A1 | 4/2011 | Bateman |
| 2011/0240845 | A1 | 10/2011 | Ding et al. |
| 2012/0112056 | A1 | 5/2012 | Brucker et al. |
| 2012/0282641 | A1 | 11/2012 | Reilly et al. |
| 2013/0175440 | A1 | 7/2013 | Perelman et al. |
| 2013/0124099 | A1 | 8/2013 | Ecker |
| 2013/0200261 | A1 | 8/2013 | Mizutani et al. |
| 2013/0234017 | A1 | 9/2013 | Kaltashov et al. |
| 2013/0327934 | A1 | 12/2013 | Makarov et al. |
| 2014/0197333 | A1 | 7/2014 | Jolliffe et al. |
| 2014/0346344 | A1 | 11/2014 | Chen |
| 2015/0008316 | A1 | 1/2015 | Guna |
| 2015/0021472 | A1 | 1/2015 | Makarov |
| 2015/0325425 | A1 | 11/2015 | Makarov |
| 2015/0331000 | A1 | 11/2015 | Collier et al. |
| 2016/0005580 | A1 | 1/2016 | Grinfeld |
| 2016/0035556 | A1 | 2/2016 | Berkout et al. |
| 2016/0181084 | A1 | 6/2016 | Smith |
| 2016/0336165 | A1 | 11/2016 | Guna |
| 2017/0040152 | A1 | 2/2017 | Makarov |
| 2017/0307565 | A1 * | 10/2017 | Clemmer ..... H01J 49/26 |
| 2017/0372883 | A1 | 12/2017 | Verenchikov |
| 2020/0243317 | A1 * | 7/2020 | Lopez-Hilfiker ..... G01N 33/46 |
| 2020/0357626 | A1 | 11/2020 | Jarrold et al. |

FOREIGN PATENT DOCUMENTS

| | | | |
|---|---|---|---|
| WO | 2000028004 | A1 | 5/2000 |
| WO | 2000028061 | A1 | 5/2000 |
| WO | 2001092551 | A2 | 5/2001 |
| WO | 003042704 | A1 | 5/2003 |
| WO | 2006130474 | A2 | 12/2006 |
| WO | 2010135830 | A1 | 12/2010 |
| WO | 20120083031 | A1 | 6/2012 |
| WO | 012145037 | A1 | 10/2012 |
| WO | 016073850 | A1 | 5/2016 |
| WO | 017162779 | A1 | 9/2017 |
| WO | 20170190031 | A1 | 11/2017 |
| WO | 20190140233 | A1 | 7/2019 |
| WO | 2019231854 | A1 | 12/2019 |

OTHER PUBLICATIONS

Koizumi et al., A novel phase-coherent programmable clock for high-precision arbitrary waveform generation applied to digital ion trap mass spectrometry_ Int. J_ Mass Spectrom_ 292, 23-31 (2010).

Konenkov et al., Matrix methods for the calculation of stability diagrams in quadrupole mass spectrometry. J. Amer. Soc. Mass Spec. 13, 597-613 {2002).

Landais et al., Varying the radio frequency: A new scanning mode for quadrupole analyzers. Rapid Commun. Mass Spectrom. 12, 302-306 (1998).

Makarov, Alexander, "Electrostatic Axially Harmonic Orbital Trapping: A High-Performance Technique of Mass Analysis", Analytical Chemistry,vol. 72, No. 6, Mar. 1, 2000 (Mar. 1, 2000), p. 1156-1162.

Marmet et al., A frequency-swept quadrupole mass filler. Int. J_ Mass Spectrom. Ion Proc. 42, 3-10 (1982).

Martin, Stability of doubly charged alkali halide clusters. J_ Chem. Phys. 76, 5467-5469 (1982).

Miyamura, K., et al. "Parvovirus Particles as Platforms for Protein Presentation", National Academy of Sciences, vol. 1,No. 18,pp. 8507-8511 (Aug. 30, 1994).

Mori, Seiichiro, Mori, et al. "Two novel adeno-associated viruses from cynomolgus monkey: pseudotyping characterization of capsid protein", Virology 330, pp. 375-383 (2004).

Muzyczka, N., "Use of Adeno-Associated Virus as a General Transduction Vector for Mammalian Cells", Current Topics n Microbiology and Immunology, vol. 158, pp. 97-129 (1992).

Muramatsu, S., et al. "Nucleotide Sequencing and Generation of an Infectious Clone of Adeno-Associated Virus 3", Virology vol. 221; Article No. 0367; pp. 208-217 (1996).

Padron, Eric, et al. "Structure of Adeno-Associated Virus Type 4", Journal of Virology, vol. 79, No. 8, pp. 5047-5058 Apr. 2005).

Puttaraju, M., et al. "Spliceosome-mediated RNA trans-splicing as a tool for gene therapy", Nature Biotechnology, vol. 17, pp. 246-252 (Mar. 1999).

Nie et al., Frequency scan of a quadrupole mass analyzer in the third stability region for protein analysis. J. Chin. Chem_ Soc., 53, 47-52 (2006).

Paul, et al., Das elektrische massenfiller, Z. Phys. 140, 262-273 (1955).

(56) References Cited

OTHER PUBLICATIONS

Pierson, Elizabeth E., et al., "Detection of 1-15 Late Intermediates in Virus Capsid Assembly by Charge Detection Mass Spectrometry", Journal of the American Chemical Society, vol. 136, No. 9, Feb. 19, 2014, 3536-3541.
Pierson, Elizabeth E., et al., 'Charge Detection Mass Spectrometry for Single Ions with an Uncertainty in the Charge Measurement of 0.65 e; Elizabeth E_ Pierson et al.; Journal American Society for Mass Spectrometry, vol. 26, pp. 1213-1220 (2015).
Pierson, Elizabeth E., et al. "Charge Detection Mass Spectrometry Identifies Preferred Non-icosahedral Polymorphs in the Self-Assembly of Woodchuck Hepatitis Virus Capsids", Jour. of Molecular Biology, vol. 428, Issue 2, pp. 292-300. Jan. 29, 2016.
Schlunegger et al., Frequency scan for the analysis of high mass ions generated by matrix-assisted laser esorption/ionization in a Paul trap_ Rapid Commun. Mass Spectrom. 13, 1792-1796 (1999).
Richards et al., A new operating mode for the quadrupole mass filler. Int. J. Mass Spectrom. Ion Phys. 12, 317-339 1973).
Richards et al., Waveform parameter tolerances for the quadrupole mass filler with rectangular excitation. Int. J. Mass Spectrom. Ion Phys_ 15, 417-428 (1974).
Sonalikar, Hrishikesh S., et al. "Numerical analysis of segmented-electrode Orbitraps", International Journal of Mass Spectrometry, Elsevier Science Publishers, Amsterdam, NL,vol. 395, Dec. 17, 2015 (Dec. 17, 2015), p. 36-48.
Shinholt, Review of Scientific Instruments. 85, 113109 (2014); doi: 10.1063/1.4900627.
Sobott et al., A tandem mass spectrometer for improved transmission and analysis of large macromolecular Assemblies. Anal. Chem. 74, 1402-1407 (2002).
Syed, et al., Quadrupole mass filler: Design and performance for operation in stability zone 3. J. Am. Soc. Mass Spectrom. 24, 1493-1500 (2013).
Shade, Rosemary, et al. "Nucleotide Sequence and Genome Organization of Human Parvovirus B19 Isolated from the Serum of a Child during plastic Crisis", Journal of Virology, vol. 58, No. 3, pp. 921-936 {Jun. 1986).
Sharp, Phillip A., et al. "RNA Interference", American Association for the Advancement of Science; Science, New Series, vol. 287, No. 5462, pp. 2431-2433 {Mar. 31, 2000).
Shi, Z., et al. "Insertional Mutagenesis at Positions 520 and 584 of Adena-Associated Virus Type 2 (MV2) Capsid Gene and Generation of MV2 Vectors with Eliminated Heparin-Binding Ability and Introduced Novel Tropism", Human Gene Therapy, vol. 17, pp. 353-361 (Mar. 2006).
Srivastava, Arun, et al., "Nucleotide Sequence and Organization of the Adena-Associated Virus 2 Genome", Journal of Virology, vol. 45, No. 2, pp. 555-564 {Feb. 1983).
Tsao, Jun, et al., "The Three-Dimensional Structure of Canine Parvovirus and Its Functional Implications", American Association for the Advancement of Science, Science, New Series, vol. 251, No. 5000, pp. 1456-1464 {Mar. 22, 991).
Walters, Robert W., "Structure of Adeno-Associated Virus Serotype 5", Journal of Virology, vol. 78, No. 7, pp. B361-3371 {Apr. 2004).
Wang, Lei, et al., "Expanding the Genetic Code", Annual Review of Biophysics and Biomolecular Structure, vol. 35, pp. 25-249 {2006).
Xie, Qing, et al., "Canine Parvovirus Capsid Structure, Analyzed at 2.9 A Resolution", Journal of Molecular Biology, vol. 64, pp. 497-520 (1996).
Xie, Qing, et al., "The atomic structure of adeno-associated virus (MV-2), a vector for human gene therapy", PNAS, vol. 99, No. 16, pp. 10405-10410 (Aug. 6, 2002).
Xiao, Weidong, et al., "Gene Therapy Vectors Based on Adena-Associated Virus Type 1", Journal of Virology, vol. 73, No. 5, pp. 3994-4003 (May 1999).
Uetrecht et al., "Stability and Shape of Hepatitis B Virus Capsids in Vacuo", Angew. Chem. Int. Ed. 2008, 47, 6247-6251.
Uetrecht et al., "High-resolution mass spectrometry of viral assemblies: Molecular composition and stability of dimorphic hepatitis B virus capsids", PNAS 2008, vol. 105, 9216-9920.
Winger, et al., Observation and implications of high mass-lo-charge ratio ions from electrospray ionization mass spectrometry, J_ Am_ Soc_ Mass Spectrom. 4, 536-545 (1993).
Xiong, et al., The development of charge detection-quadrupole ion trap mass spectrometry driven by rectangular and triangularwaves, Analyst 137, 1199-1204 (2012).
Yang, et al., Development of a palm portable mass spectrometer. J. Amer. Soc. Mass Spec. 19, 1442-1448 (2008).
Yost, et al., Selected ion fragmentation with a tandem quadrupole mass spectrometer. J. Am. Chem. Soc. 100, 274-2275 (1978).
Bioconjugate Techniques; Hermanson; .Academic Press, 1st Edition (1996),. (book reference, to be made available upon request).
PCT International Search Report and Written Opinion completed by the ISA/EP dated Apr. 16, 2019 and issued in connection with PCT/US2019/013251.
PCT International Search Report and Written Opinion completed by the ISA/EP dated Apr. 16, 2019 and issued in connection with PCT/US2019/013274.
PCT International Search Report and Written Opinion completed by the ISA/EP dated Mar. 27, 2019 and issued in connection with PCT/US2019/013277.
PCT International Search Report and Written Opinion completed by the ISA/EP dated Jul. 24, 2019 and issued in connection with PCT/US2019/013278.
PCT International Search Report and Written Opinion completed by the ISA/EP dated Sep. 9, 2019 and issued in connection with PCT/US2019/013279.
PCT International Search Report and Written Opinion completed by the ISA/EP dated Mar. 28, 2019 and issued in connection with PCT/US2019/013280.
PCT International Search Report and Written Opinion completed by the ISA/EP dated Aug. 27, 2019 and issued in connection with PCT/US2019/013281.
PCT International Search Report and Written Opinion completed by the ISA/EP dated Mar. 27, 2019 and issued in connection with PCT/US2019/013283.
PCT International Search Report and Written Opinion completed by the ISA/EP dated Mar. 29, 2019 and issued in connection with PCT/US2019/013284.
PCT International Search Report and Written Opinion completed by the ISA/EP dated Jul. 26, 2019 and issued in connection with PCT/US2019/013285.
PCT International Search Report and Written Opinion completed by the ISA/US dated Jan. 12, 2016 and issued in connection with PCT/US2015/059463.
PCT International Search Report and Written Opinion completed by the ISA/US dated Jun. 19, 2017 and issued in connection with PCT/US2017/030163.
PCT International Search Report and Written Opinion completed by the ISA/EP dated Feb. 14, 2019 and issued in connection with PCT/US2018/051944.
Supplemental European Search Report for European Patent Application No. 17790559.3 dated Nov. 12, 2019 (11 pages).
Anthony, Staci N. "MS /MS instrumentation for megadalton-sized ions", 2016, XP055619426, ISBN: 978-1-369-02558-3 Retrieved from the Internet: URL:https://search.proquest.com/docview/1830450391?accountid=29404.
Anthony, et al., A simple electrospray interface based on a DC ion carpet, Int. J. Mass Spectrom. 371, 1-7 (2014).
Bantel-Schall, U., et al., "Human Adena-Associated Virus Type 5 Is Only Distantly Related to Other Known Primate Helper-Dependent Parvoviruses", Journal of Virology, vol. 73, pp. 939-947 {Feb. 1999).
Beuhler, et al., Threshold studies of secondary electron emission induced by macro ion impact on solid surfaces. Nucl. Instrum. Methods. 170, 309-315 (1980).
Beuhler, et al., A study of the formation of high molecular weight water cluster ions {m/e < 59000) in expansion of ionized gas mixtures, J. Chem. Phys. 77, 2549-2557 (1982).
Brancia, et al., Digital asymmetric waveform isolation {DAWI) in a digital linear ion trap. J_ Am. Soc_ Mass Spectrom. 1. 1530-1533 (2010).

(56) References Cited

OTHER PUBLICATIONS

Brown, C., et al. "Chimeric Parvovirus B19 Capsids for the Presentation of Foreign Epitope",; Virology 198, pp. J77-488 (1994).
Burnham, et al. "Analytical Ultracentrifugation as an Approach to Characterize Recombinant Adena-Associated Viral Vectors", Human Gene Therapy Methods, vol. 26, No. 6; pp. 228-242, Oct. 15, 2015.
Chao, Hengjun, et al. "Several Log Increase in Therapeutic Transgene Delivery by Distinct Adena-Associated Viral Serotype Vectors" Molecular Therapy vol. 2, No. 6, pp. 619-623 {Dec. 2000).
Chiorini, John A., et al. "Cloning of Adeno-Associated Virus Type 4 (MV4) and Generation of Recombinant MV4 Particles",Joumal of Virology, vol. 71, pp. 6823-6833 {Sep. 1997).
Chiorini, John A., "Cloning and Characterization of Adeno-Associated Virus Type 5", Journal of Virology, vol. 73, DP-1309-1319 {Feb. 1999).
Chernushevich, et al., Collisional cooling of large ions in electrospray mass spectrometry. Anal. Chem 76. H54-1760 (2004).
Cleves, Ann E., "Protein transport: The nonclassical ins and outs", Current Biology, vol. 7, No. 5, pp. 318-320 (1997).
Contino, Nathan Colby, "Ion trap charge detection mass spectrometry: Lowering limits of detection and improving signal to noise", ISBN: 9781303535048, Jul. 30, 2013 (Jul. 30, 2013).
Ding, et al., A simulation study of the digital ion trap mass spectrometer. Int. J. Mass Spectrom. 221, 117-138 {2002).
Ding, et al, A digital ion trap mass spectrometer coupled with atmospheric pressure ion sources. J_ Mass Spectrom. 69, 471-484 (2004).
Douglas J_ Linear quadrupoles in mass spectrometry. Mass Spectrom. Rev. 28, 937-960 (2009).
Doussineau, Tristan, et al. "Infrared multiphoton dissociation tandem charge detection-mass spectrometry of single megadalton electrosprayed ions", Review of Scientific Instruments, AIP, Melville, NY, US, vol. 82, No. 8, Aug. 1, 2011, pp. 84104-84104.
Elliott, Andrew G., et al. "Simultaneous Measurements of Mass and Collisional Cross-Section of Single Ions with charge Detection Mass Spectrometry", Analytical Chemistry, vol. 89, No. 14, Jun. 16, 2017, pp. 7701-7708.
Elliott, Andrew G., et al. "Effects of Individual Ion Energies on Charge Measurements in Fourier Transform Charge Detection Mass Spectrometry (FT-CDMS)", Journal of the American Society for Mass Spectrometry.,Nov. 14, 2018 (Nov. 14, 2018).
Elliott, Andrew G., et al. "Single Particle Analyzer of Mass: A Charge Detection Mass Spectrometer with a Multi-Detector Electrostatic Ion Trap", International Journal of Mass Spectrometry, Elsevier Science Publishers, Amsterdam, NL, vol. 414, Jan. 15, 2017, pp. 45-55.
Emerson, S., et al. "Hepatitis E Virus", Virology, vol. 2, Chapter 70; (4th ed., Lippincott-Raven Publishers).
Fields, Bernard, et al. "Darvoviridae: The Viruses and Their Replication" Virology, vol. 2, Chapter 69, pp. 2327-2359; 4th ed., Lippincott-Raven Publishers).
Fuerstenau, et al., "Mass Spectrometry of an Intact Virus", Agnew. Chem. 2001, 559-562.
Gao, Guangping, et al. "Clades of Adeno-Associated Viruses Are Widely Disseminated in Human Tissues", vol. 78, pp. 6381-6388 (Jun. 2004).
Gao, Guangping, et al. "Novel Adeno-Associated Viruses from Rhesus Monkeys as Vectors for Human GeneTherap",., National Academy of Sciences, vol. 99, No. 18, pp. 11854-11859 {Sep. 3, 2002).
Gorman, Linda, et al. "Stable Alteration of Pre-mRNA Splicing Patterns by Modified U7 Small Nuclear RNAs", National Academy of Sciences, vol. 95, No. 9, pp. 4929-4934 (Apr. 28, 1998).
Grifman, M., et al. "Incorporation of Tumor-Targeting Peptides into Recombinant Adeno-associated Virus Capsids",.; Molecular Therapy, vol. 3, No. 6, pp. 964-975 (Jun. 2001).
Grinfeld, Dmitry, et al. "Space-Charge Effects in an Electrostatic Multireflection Ion Trap", European Journal of Mass Spectrometry,vol. 20, No. 2, Apr. 1, 2014 (Apr. 1, 2014), p. 131-142.
Hauck, B., et al. "Characterization of Tissue Tropism Determinants of Adeno-Associated Virus Type 1", Journal of Virology, vol. 77, No. 4, pp. 2768-2774 (Feb. 2003).
Hogan, Joanna, et al. "Optimized Electrostatic Linear Ion Trap for Charge Detection Mass Spectrometry", Jul. 9, 2018 (Jul. 9, 2018), vol. 29, No. 10, p. 2086-2095.
Keifer, David Z., "Single-Molecule Mass Spectrometry", Mass Spectrometry Reviews, vol. 36 pp. 715-733 (2017).
Keifer, David Z., et al. "Charge detection mass spectrometry: weighing heavier things" The Analyst, vol. 142, No. 1, Jan. 1, 2017, pp. 1654-1671.
Keifer, David Z., et al. "Charge Detection Mass Spectrometry with Almost Perfect Charge Accuracy", Analytical Chemistry, vol. 87, No. 20, Oct. 20, 2015, pp. 10330-10337.
Kelly, Ryan T., et al. "The ion funnel: Theory, implementations, and applications", Mass Spectrometry Reviews., vol. 29, Apr. 23, 2009, pp. 294-312.
Kim et al., A multicapillary inlet jet disruption electrodynamic ion funnel interface for improved sensitivity using tmospheric pressure ion sources. Anal. Chem. 73, 4162-4170 {2001).
Botamanenko, Daniel, et al., "Ion-Ion Interactions in Charge Detection Mass Spectrometry", J Am Soc Mass Spectrom. Dec. 2019 ; 30(12): 2741-2749. doi:10.1007/s13361-019-02343-y.
Draper, Benjamin E., et al., "Real-Time Analysis and Signal Optimization for Charge Detection Mass Spectrometry", J. Am. Soc. Mass Spectrom. (2019) 30:898Y904.
Todd, Aaron R., et al. "Implementation of a Charge-Sensitive Amplifier without a Feedback Resistor for Charge Detection Mass Spectrometry Reduces Noise and Enables Detection of Individual Ions Carrying a Single Charge", J. Am. Soc. Mass Spectrom. 2020, 31, 146-154.
PCT International Search Report and Written Opinion completed by the ISA/EP dated Jul. 14, 2020 and issued in connection with PCT/US2020/029287.
PCT International Search Report and Written Opinion completed by the ISA/US dated Nov. 23, 2020 and issued in connection with PCT/US2020/052009.
PCT International Search Report and Written Opinion completed by the ISA/US dated Jan. 24, 2021 and issued in connection with PCT/US2020/054975.
Charge Detection Mass Spectrometry of Bacteriophage P22 Procapsid Distributions Above 20MDa, David Keifer et al, Rapid Communications in Mass Spectrometry, vol. 28, No. 5.
Charge Detection Mass Spectrometry: Instrumentation & Applications to Viruses, Elizabeth Pierson, Proquest Dissertations and Theses; Thesis (Ph.D.) vol. 76-09(E), Section: B. 168.
Defining the Stoichiometry and Cargo Load of Viral and Bacterial Nanoparticles by Orbitrap Mass Spectrometry, Snijder, J. et al, J. Am. Chem. Soc. 2014, 136, 7295-7299.
Analysis of a Common Cold Virus and Its Subviral Particles by Gas-Phase Electrophoretic Mobility Molecular Analysis and Native Mass Spectrometry, Weiss Vu et al, Anal Chern. 2015.
Product-Related Impurities in Clinical-Grade Recombinant AAV Vectors: Characterization and Risk Assessment, J Fraser Wright, Biomedicines 2014, 2, 80-97.
European Office Action dated Sep. 2, 2021 in application 19 707 901.5.
Draper, Benjamin E., "The FUNPET—a New Hybrid Ion Funnel-Ion Carpet Atmospheric Pressure Interface for the Simultaneous Transmission of a Broad Mass Range", Journal of the American Society of Mass Spectrometry 29, 2160-2172, Aug. 15, 2018.
El-Baba, Tarick J., et al., "Melting Proteins Confined in Nanodroplets With 10.6 um Light Provided Clues About Early Steps of Denaturation", Chemical Communications, vol. 54, No. 26, 3270-3273, 2018.
Heller, Manfred, et al. "Mass Spectrometry-Based Analytical Tools for the Molecular Protein Characterization of Human Plasma Lipoproteins", Proteomics 2005, 5, 2619-2630.
Hutchins, Patrick M., et al. "Quantification of HDL Particle Concentration by Calibrated Ion Mobility Analysis", Clinical Chemistry 60:11, 1393-1401, 2014.
Kukreja, Alexander A., et al. "Structurally Similar Woodchuck and Human Hepadnavirus Core Proteins Having Distinctly Different

(56) References Cited

OTHER PUBLICATIONS

Temperature Dependencies of Assembly" Journal of Virology, vol. 68, No. 24, 14105-14115, Sep. 24, 2014.
PCT International Search Report and Written Opinion completed by the ISA/EP dated Sep. 9 2019 and issued in connection with PCT/US2019/035379.
PCT International Search Report and Written Opinion completed by the ISA/EP dated Aug. 27, 2019 and issued in connection with PCT/US2019/035381.
PCT International Search Report and Written Opinion completed by the ISA/EP dated Mar. 8, 2021 and issued in connection with PCT/US2020/065300.
PCT International Search Report and Written Opinion completed by the ISA/EP dated Mar. 8, 2021 and issued in connection with PCT/US2020/065301.
PCT International Search Report and Written Opinion completed by the ISA/US dated Apr. 5, 2021 and issued in connection with PCT/US2021/016435.
PCT International Search Report and Written Opinion completed by the ISA/US dated Mar. 18, 2021 and issued in connection with PCT/US2021/016325.
Analysis of a common cold virus and its subviral particles by gas-phase electrophoretic mobility molecular analysis and native mass spectrometry, Weiss Vu et al., Anal Chem. 2015.
Paul et al., Das elektrische massenfilter als massenspektromeler und isotopenlrenner. Z. Phys. 152, 143-182 (1958).

* cited by examiner

ABUNDANCE
0
5
10
15
20
25
30
MASS (MDa)

INTERFACE FOR TRANSPORTING IONS FROM AN ATMOSPHERIC PRESSURE ENVIRONMENT TO A LOW PRESSURE ENVIRONMENT

CROSS-REFERENCE TO RELATED APPLICATIONS

This application is a U.S. national stage entry of PCT Application No. PCT/US2019/035379, filed Jun. 4, 2019, which claims the benefit of and priority to U.S. Provisional Patent Application Ser. No. 62/680,223, filed Jun. 4, 2018, and is a continuation-in-part of PCT/US2019/013274, filed Jan. 11, 2019, the disclosures of which are incorporated herein by reference in their entireties.

GOVERNMENT RIGHTS

This invention was made with government support under CHE1531823 awarded by the National Science Foundation. The United States Government has certain rights in the invention.

FIELD OF THE DISCLOSURE

This disclosure relates generally to instruments for transporting ions of a broad mass range from an a higher pressure environment to a lower pressure environment, and more specifically to such instruments configured to transport such ions in a manner which results in the transported ions having low excess kinetic energy.

BACKGROUND

Mass Spectrometry provides for the identification of chemical components of a substance by separating gaseous ions of the substance according to ion mass and charge. Various instruments and techniques have been developed for determining the masses of such separated ions, and one such technique is known as charge detection mass spectrometry (CDMS). CDMS directly measures a charge state of individual ions, rather than a packet of ions, as they pass through an electrode and induce a charge on the electrode. Ions processed by CDMS are typically generated using a conventional electrospray ionization (ESI) source which produces the ions in the form of a mist or aerosol. ESI is an ambient ionization technique, which requires an interface to transfer ions from ambient pressure to the high vacuum environment required for mass spectrometry measurements. A large pressure difference between atmospheric pressure and a first region of the mass spectrometer creates a directed gas flow that transports ions into the mass spectrometer. However, upon entering the first region of the mass spectrometer, the directed gas flow forms a supersonic jet that accelerates the ions transported in the flow to supersonic velocities. A resulting wide distribution of ion energies causes difficulty in focusing the ions, thereby lowering ion transmission. In particular, analyzing high-mass ions, e.g., in the megadalton regime such as large protein complexes, viruses and the like, is difficult due to a large amount of energy picked up by such ions from the jet, thereby resulting in the wide distribution of ion energies.

SUMMARY

The present disclosure may comprise one or more of the features recited in the attached claims, and/or one or more of the following features and combinations thereof. In one aspect, an interface for transporting ions from an environment at a first pressure into an analysis instrument controlled to an instrument pressure that is less than the first pressure may comprise a first region, a first pump configured to establish a second pressure in the first region that is less than the first pressure and greater than the instrument pressure, a first ion funnel disposed in the first region and having a first drift region defining a first end, an opposite second end and a first axial passageway therethrough, and a first funnel region defining a first end coupled to the second end of the first drift region, an opposite second end and a second axial passageway therethrough that tapers from a cross-sectional area of the first axial passageway at the first end of the first funnel region to a reduced cross-sectional area at the second end thereof, wherein the ions from the environment enter the first end of the first drift region and exit at the second end of the first funnel region, and wherein the second axial passageway defines a first virtual jet disrupter therein, a first ion carpet disposed in the first region opposite the second end of the first ion funnel and defining a first ion outlet therethrough, a second region, a second pump configured to establish a third pressure in the second region that is less than the second pressure and greater than the instrument pressure, a second ion funnel disposed in the second region and having a second drift region defining a first end, an opposite second end and a third axial passageway therethrough, and a second funnel region defining a first end coupled to the second end of the second drift region, an opposite second end and a fourth axial passageway therethrough that tapers from a cross-sectional area of the third axial passageway at the first end of the second funnel region to a reduced cross-sectional area at the second end thereof, wherein ions exiting the first ion funnel enter the first end of the second drift region and exit at the second end of the second funnel region, and wherein the fourth axial passageway defines a second virtual jet disrupter therein, and a second ion carpet disposed in the second region opposite the second end of the second ion funnel and defining a second ion outlet therethrough, wherein ions exiting the second ion outlet enter an ion inlet of the analysis instrument.

In another aspect, an interface for transporting ions from an environment at a first pressure into an analysis instrument controlled to an instrument pressure that is less than the first pressure may comprise a first region, a first pump configured to establish a second pressure in the first region that is less than the first pressure and greater than the instrument pressure, a first ion funnel disposed in the first region and having a first drift region defining a first end, an opposite second end and a first axial passageway therethrough, and a first funnel region defining a first end coupled to the second end of the first drift region, an opposite second end and a second axial passageway therethrough that tapers from a cross-sectional area of the first axial passageway at the first end of the first funnel region to a reduced cross-sectional area at the second end thereof, wherein the ions from the environment enter the first end of the first drift region and exit at the second end of the first funnel region, a first ion carpet disposed in the first region opposite the second end of the first ion funnel and defining a first ion outlet therethrough, a second region, a second pump configured to establish a third pressure in the second region that is less than the second pressure and greater than the instrument pressure, a second ion funnel disposed in the second region and having a second drift region defining a first end, an opposite second end and a third axial passageway therethrough, and a second funnel region defining a first end coupled to the second end of the second drift region, an opposite second end and a fourth axial passageway therethrough that tapers from a cross-sectional area of the third axial passageway at the first end of the second funnel region to a reduced cross-sectional area at the second end thereof, wherein ions exiting the first ion funnel enter the first end of the second drift region and exit at the second end of the second funnel region, and a second ion carpet disposed in the second region opposite the second end of the second ion funnel and defining a second ion outlet therethrough, wherein ions exiting the second ion outlet enter an ion inlet of the analysis instrument, wherein a combination of pressure build-up and a gas counter-flow within the first funnel region creates a first area within the first funnel region which at least partially thermalizes the ions passing through the first ion funnel, and wherein a combination of pressure build-up and a gas counter-flow within the second funnel region creates a second area within the second funnel region which at least partially thermalizes the ions passing through the second ion funnel.

In yet another aspect, an interface for transporting ions from an environment at a first pressure into an analysis instrument controlled to an instrument pressure that is less than the first pressure may comprise a first region, a first pump configured to establish a second pressure in the first region that is less than the first pressure and greater than the instrument pressure, a first ion funnel disposed in the first region and having a first drift region defining a first end, an opposite second end and a first axial passageway therethrough, and a first funnel region defining a first end coupled to the second end of the first drift region, an opposite second end and a second axial passageway therethrough that tapers from a cross-sectional area of the first axial passageway at the first end of the first funnel region to a reduced cross-sectional area at the second end thereof, wherein the ions from the environment enter the first end of the first drift region and exit at the second end of the first funnel region, a first ion carpet disposed in the first region opposite the second end of the first ion funnel and defining a first ion outlet therethrough, a second region, a second pump configured to establish a third pressure in the second region that is less than the second pressure and greater than the instrument pressure, a second ion funnel disposed in the second region and having a second drift region defining a first end, an opposite second end and a third axial passageway therethrough, and a second funnel region defining a first end coupled to the second end of the second drift region, an opposite second end and a fourth axial passageway therethrough that tapers from a cross-sectional area of the third axial passageway at the first end of the second funnel region to a reduced cross-sectional area at the second end thereof, wherein ions exiting the first ion funnel enter the first end of the second drift region and exit at the second end of the second funnel region, and a second ion carpet disposed in the second region opposite the second end of the second ion funnel and defining a second ion outlet therethrough, wherein ions exiting the second ion outlet enter an ion inlet of the analysis instrument, wherein a pressure difference between the first pressure and the second pressure creates a first gas flow which transports the ions into the first end of the first drift region, and the tapered second axial passageway of the first funnel region reduces the first gas flow, and wherein a pressure difference between the second pressure and the third pressure creates the second gas flow which transports ions exiting the first ion funnel into the first end of the second drift region, and the tapered fourth axial passageway of the second funnel region reduces the second gas flow.

In a further aspect, a system for analyzing ions may comprise an ion source configured to generate ions in the environment at the first pressure, the interface described in any of the preceding aspects coupled to the ion source such that the generated ions enter the first axial passageway of the first ion funnel, and an ion separation instrument disposed in a vacuum environment and coupled to the interface such that ions exiting the second ion outlet of the second ion carpet enter the ion separation instrument, the ion separation instrument configured to separate ions based on at least one molecular characteristic.

In still a further aspect, a system for separating ions may comprise an ion source configured to generate ions from a sample in the environment at the first pressure, the interface described in any of the preceding aspects coupled to the ion source such that the generated ions enter the first axial passageway of the first ion funnel, at least one ion separation instrument disposed in a vacuum environment and coupled to the interface such that ions exiting the second ion outlet of the second ion carpet enter the ion separation instrument, the ion separation instrument configured to separate ions as a function of at least one molecular characteristic, and a detector configured to measure charge and mass-to-charge ratio of ions exiting the at least one ion separation instrument.

In yet a further aspect, a system for separating ions may comprise an ion source configured to generate ions from a sample in the environment at the first pressure, the interface described in any of the preceding aspects coupled to the ion source such that the generated ions enter the first axial passageway of the first ion funnel, a first mass spectrometer coupled to the interface such that ions exiting the second ion outlet of the second ion carpet enter the ion separation instrument, the ion separation instrument configured to separate ions as a function of mass-to-charge ratio, an ion dissociation stage positioned to receive ions exiting the first mass spectrometer and configured to dissociate ions exiting the first mass spectrometer, a second mass spectrometer configured to separate dissociated ions exiting the ion dissociation stage as a function of mass-to-charge ratio, and a charge detection mass spectrometer (CDMS), coupled in parallel with and to the ion dissociation stage such that the CDMS can receive ions exiting either of the first mass spectrometer and the ion dissociation stage, wherein masses of precursor ions exiting the first mass spectrometer are measured using CDMS, mass-to-charge ratios of dissociated ions of precursor ions having mass values below a threshold mass are measured using the second mass spectrometer, and mass-to-charge ratios and charge values of dissociated ions of precursor ions having mass values at or above the threshold mass are measured using the CDMS.

DESCRIPTION OF THE ILLUSTRATIVE EMBODIMENTS

Figure 1A:
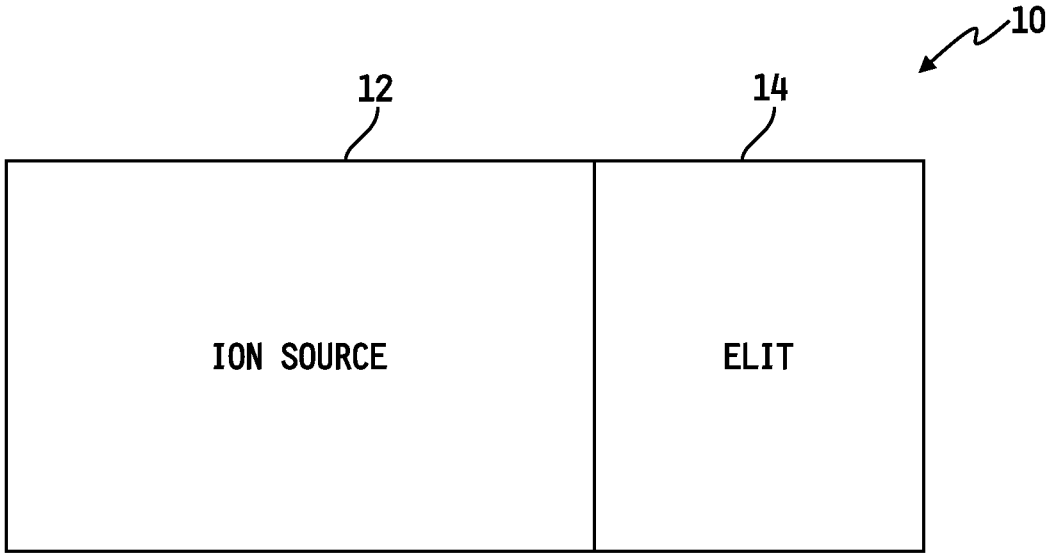
FIG. 1A is a simplified diagram of an embodiment of charge detection mass spectrometer (CDMS) including an ion detector in the form of an electrostatic linear ion trap (ELIT).

For the purposes of promoting an understanding of the principles of this disclosure, reference will now be made to a number of illustrative embodiments shown in the attached drawings and specific language will be used to describe the same.

As discussed above, a wide distribution of ion energies of ions in a front region of a mass spectrometer is undesirable because it is difficult to focus such ions, thereby lowering ion transmission. In order to focus the ions and efficiently transmit ions of interest, the ions may be thermalized in order to accelerate to a known energy by using an ion funnel interface and/or an ion carpet interface in mass spectrometry.

The ion funnel illustratively consists of a series of closely spaced ring electrodes with some having a constant inner diameter defining a drift region before tapering down in a funnel region to an exit aperture. The ion funnel confines and directs ions towards the exit aperture using both radio frequency (RF) and direct current (DC) potentials. RF signals, 180° out of phase, are applied to adjacent electrodes, with the DC drift field superimposed to drive ions towards the exit aperture. However, when the aperture diameter and the electrode spacing are comparable, the RF field creates axial wells that can trap ions and prevent them from being transmitted. To mitigate this effect, the size of the aperture can be increased, the electrode spacing can be decreased, or the RF potentials can be removed from the final electrodes. It should be noted that increasing the aperture size increases the gas load on subsequent regions of the instrument, decreasing the electrode spacing increases the complexity and capacitance (increasing power requirements), and removing RF from the final electrodes reduces confinement and contributes to ion loss. As will be described in detail below, an ion funnel and the drift region may be configured to form a virtual jet disrupter therein.

An ion carpet or RF carpet may be positioned at or adjacent to the ion outlet of the ion funnel. In such embodiments, the ion carpet illustratively consists of a series of concentric ring electrodes disposed on a substrate with a small aperture defined through the center which serves as an ion outlet aperture of the interface. Similar to the ion funnel, RF voltages are applied 180° out of phase on adjacent electrodes, with a DC drift field superimposed to drive ions into and through the ion outlet aperture. It has also been shown that an ion carpet can provide high ion transmission in DC-only mode.

Ion trajectory simulations are typically performed to model a mass spectrometer interface before construction. The most widely-used program for these simulations is SIMION. In addition to modeling the electric fields that are created by a user-generated device, additional programs have been written and incorporated to allow the inclusion of gas flow effects and model diffusion. However, the statistical diffusion simulation (SDS) model used in SIMION for intermediate pressures is limited to modeling ion sizes up to 10,000 times the mass of the background gas. This mass restriction limits the program to modeling ion masses of approximately 300 kilodaltons (kDa), when the background gas is air and thus it is inappropriate for modeling the very large biomolecules of interest here.

Other custom ion trajectory simulations have been written that use an ion mobility model with both fast adjusting and pseudopotential RF fields. However, the fast adjusting RF simulations also break down at large ion mass, and the pseudopotential simulation does not accurately model low frequencies. This is because the pseudopotential is inversely proportional to the square of the frequency, and thus lower frequencies only increase the strength of the pseudopotential, which would increase confinement in, say, a series of ring electrodes. However, it is possible for the frequency to oscillate too slowly to properly confine ions, and the pseudopotential model does not reflect this.

There are two methods for simulating gas flow, the choice depending on the gas density. For simulating high density flows, the continuum assumption is appropriate because the microscopic fluctuations in the fluid density are small compared to the length scale of the region being simulated. Continuum gas flow is well-characterized by numerical solutions to the Navier-Stokes equation. The continuum assumption fails for low density flows where local fluctuations are significant such that the gas must be treated as individual particles. These flows are characterized by probabilistic solutions to the Boltzmann equation using the Direct Simulation Monte Carlo method (DSMC) developed by Bird. Mass spectrometer interfaces often have intermediate densities that fall within the transitional flow regime. The best solver for this regime can vary depending on pumping and interface geometry.

With increasing interest in mass spectrometry measurements for large ions, e.g., in the megadalton (MDa) range, it is important to characterize interfaces for large ions. In the illustrative embodiment, the FUNPET Interface is designed to maximize ion transmission while minimizing excess kinetic energy for a broad mass range of ions by characterizing trajectories of kilodalton to gigadalton-sized ions in a flowing gas. To simulate ion motion, a new ion trajectory program was written using the velocity Verlet algorithm with Langevin dynamics. It incorporates electric fields from SIMION 8.1, drag from gas flow information, diffusion, and gravity.

Referring now to FIG. 1A, a charge detection mass spectrometer (CDMS) 10 is shown having an ion source 12 operatively coupled to an electrostatic linear ion trap (ELIT) 14 for measuring ion charge and mass-to-charge ratio. In alternate embodiments, ion measurements may be made with an orbitrap or other single-particle measurement device or instrument. The ion source 12 illustratively includes an ion source, i.e., generator, of ions and an ion separation instrument positioned between the ion generator and the ion separation instrument. In the CDMS 10, the ion separation instrument is illustratively provided in the form of one or more conventional ion mass spectrometers. In other implementations, the ion separation instrument may alternatively be or include one or any combination of conventional instruments for separating ions based on one or more molecular characteristics, examples of which may include, but are not limited to, mass, mobility, retention time, particle size, or the like. Moreover, it will be understood that while the FUNPET interface is illustrated in the attached figures and described herein as being implemented in a front end (e.g., between an ion source and a mass spectrometer or mass analyzer) of a charge detection mass spectrometer (CDMS) 10, this disclosure contemplates that the FUNPET interface may alternatively be implemented in any spectrometer arrangement in which it is desirable to thermalize ions and/or reduce gas flow prior to ion separation according to one or more molecular characteristics.

Figure 1B:
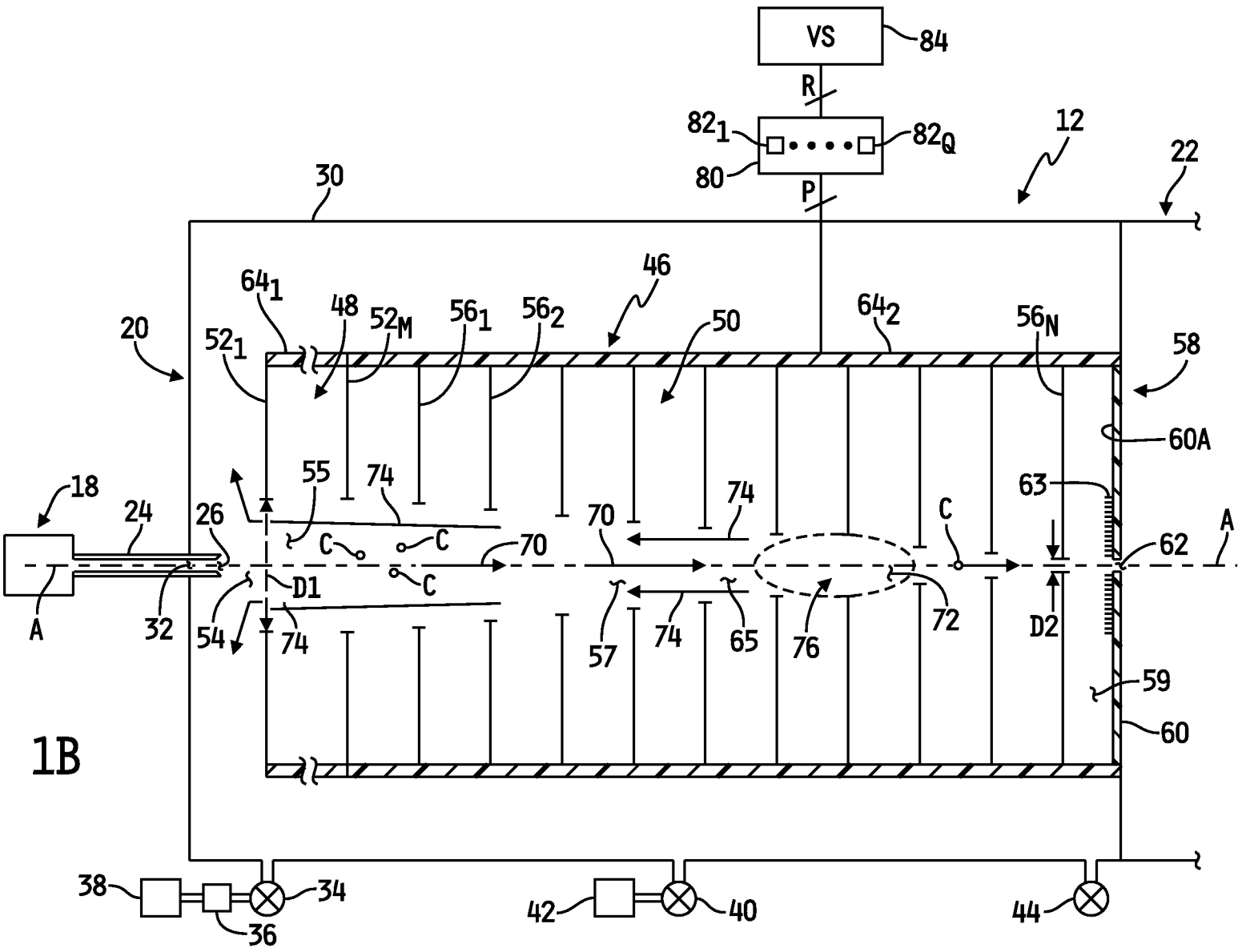
FIG. 1B is a simplified diagram of an embodiment of the ion source of the CDMS of FIG. 1A which includes a hybrid ion funnel-ion carpet (FUNPET) interface operatively positioned between an ion generator and a mass spectrometer.

Referring now to FIG. 1B, an embodiment is shown of the ion source 12 illustrated in FIG. 1A. In the embodiment depicted in FIG. 1B, the ion source 12 illustratively includes a source of ions 18, i.e., a conventional ion generation device, operatively coupled to an ion inlet of a conventional mass spectrometer or mass analyzer 22 via an ion transport interface 20. In the illustrated embodiment, the ion generator 18 is provided in the form of a conventional electrospray ionization (ESI) source having a capillary 24 defining an ion outlet 26 at one end thereof. Although not shown in FIG. 1B, the ESI source 18 is fluidly coupled to a sample solution, and is operable in a conventional manner to generate ions, i.e., charged particles C, which exit the ion outlet 26. As discussed above, the ESI source 18 is an ambient ionization technique, i.e., one which ionizes the sample solution at ambient pressures. In other embodiments, other known ion generation devices may be used which also operate to generate ions in an ambient environment. As conventional mass spectrometers operate in a high vacuum environment, however, the ion transport interface 20 illustratively serves as an interface for transporting ions from ambient pressures in and around the ion generation device 18 to the low-pressure (i.e., high vacuum) environment of the mass spectrometer 22.

In the embodiment depicted in FIG. 1B, the ion transport interface 20 is illustratively provided in the form of a hybrid ion funnel-ion carpet (FUNPET) interface fluidly coupled to and between the ion ESI source 18 and the mass spectrometer 22. In the illustrated embodiment, the FUNPET interface 20 includes a vacuum chamber or housing 30 having an ion inlet 32 through which the capillary 24 of the ESI source 18 extends such that the ion outlet 26 of the capillary 24 extends into the vacuum chamber 30. In alternate embodiments, the capillary 24 may be configured to engage the ion inlet 32 of the vacuum chamber 30 such that the ion outlet 26 of the capillary 24 terminates at or extends through the ion inlet 32 and into the vacuum chamber 30.

In the illustrated embodiment, a valve 34 is fluidly coupled between the interior of the vacuum chamber 30 and a conventional pump 36, and the pump 36 is fluidly coupled to a source of gas. In such embodiments, the valve 34 and pump 36 may be controlled, e.g., automatically by a processor or controller or by hand, to controllably add gas from the gas source 38 to the interior of the chamber 30. Also in the illustrated embodiment, another valve 40 is fluidly coupled between the interior of the vacuum chamber 30 and a conventional vacuum pump 42. In such embodiments, the valve 40 and/or pump 40 may be controlled, e.g., automatically or by hand, to control a vacuum level within the vacuum chamber 30. Further still in the illustrated embodiment, yet another valve 44 is fluidly coupled to the interior of the vacuum chamber 30. In such embodiments, the valve 44 may be controlled, e.g., automatically or by hand, to control release gas and/or vacuum from the vacuum chamber 30.

The FUNPET interface 20 further includes an ion funnel 46 disposed within the vacuum chamber 30 between the ESI source 18 and the mass spectrometer 22 as illustrated by example in FIG. 1B. The ion funnel 46 is illustratively positioned and configured to receive the generated ions C therein. The large pressure difference between the atmospheric conditions at the ESI source 18 and the vacuum conditions at the outlet 26 of the capillary 24 creates a directed gas flow exiting the capillary 24 in the form of a supersonic jet which transports ions generated by the ESI source 18 into the inlet 54 of the ion funnel 46. As will be described in detail below, the ion funnel 46 defines a virtual jet disrupter 76 therein which dissipates the supersonic jet exiting the capillary 24 of the ESI source 18 and which also thermalizes the ions within the funnel 46 as the ions are being transported by the ion funnel 46 into the mass spectrometer 22.

In the illustrated embodiment, the ion funnel 46 illustratively includes a constant aperture region 48 spaced apart from the ion outlet 26 of the ESI capillary 24 and a tapering funnel region 50 fluidly coupled to and extending from the constant aperture region 48. The constant aperture region 48 of the ion funnel 46 is illustratively formed of a number M of constant-aperture, spaced-apart electrically conductive ring electrodes $\mathbf{52}_1$-$\mathbf{52}_M$, where M may be any positive integer. The constant aperture ring electrodes $\mathbf{52}_1$-$\mathbf{52}_M$ each illustratively have an inner diameter D1 such that the sequence of ring electrodes $\mathbf{52}_1$-$\mathbf{52}_M$ together define a constant-aperture drift region 55 axially therethrough of constant diameter D1 and length defined by the collective widths of the ring electrodes $51_1$-$51_M$ and spaces therebetween. The first ring electrode $52_1$ is illustratively spaced apart from the ion outlet 26 of the ESI nozzle 24, and the opening defined through the first ring electrode $52_1$ defines an ion inlet 54 to the ion funnel 46. In the embodiment illustrated in FIG. 1B, the ion outlet 26 of the ESI nozzle 24 is axially aligned, i.e., collinear, with a central, longitudinal axis A defined through the drift region 55 of the constant aperture region 48 of the ion funnel 46 (and defined centrally through the interface 20). However, it will be understood that such alignment is not required, and in other embodiments the ion outlet 26 of the ESI nozzle 24 need not be axially aligned with the axial drift region 55. The length of the constant aperture region 55 of the ion funnel 46 may vary depending upon the application.

The funnel region 50 of the ion funnel 46 is illustratively formed of a number N of spaced-apart electrically conductive ring electrodes $56_1$-$56_N$ extending axially away from the constant aperture region 48 toward the mass spectrometer 22, where the apertures of the ring electrodes $56_1$-$56_N$ linearly decrease in diameter in the direction toward the mass spectrometer 22. Illustratively, the first ring electrode $56_1$ has an inner diameter that is slightly less than the diameter D1 of the last ring electrode $52_M$ of the constant diameter region 48, and the inner diameters of the remaining ring electrodes $56_2$-$56_N$ sequentially decrease such that the last ring electrode $56_N$ has an inner diameter $D_2<D_1$ which defines an ion outlet aperture of the ion funnel 46. In one embodiment, the inner diameters of the ring electrodes $56_2$-$56_{N-1}$ decrease linearly, i.e., stepwise, between the ring electrodes $56_1$ and $56_N$ to define a tapered-aperture drift region 57 axially through the funnel region 50 which linearly tapers, i.e., decreases, between the ring electrodes $56_1$-$56_N$. It will be understood that the dashed lines at the inner diameters of the electrodes $52_1$-$52_M$ and $56_1$-$56_N$ are not structural components, but rather are included only to highlight the constant diameter of the drift region 55 and the linearly reducing diameter of the drift region 57. In some alternate embodiments, the inner diameters of one or more of the ring electrodes $56_1$-$56_N$ may be sized such that the drift region 57 is not strictly linearly decreasing, i.e., such that the inner diameter of the drift region 57 decreases non-linearly. In any case the drift region 55 defined by the constant-aperture region 48 of the ion funnel 46 is axially aligned with the drift region 57 of the funnel region 50 of the ion funnel 46 such that the longitudinal axis A extends centrally and axially through both drift regions 55, 57.

As further illustrated in FIG. 1B, a circuit board 80 has a number, Q, of circuit components $82_1$-$82_Q$ mounted thereto, where Q may be any positive integer. The circuit board 80 is electrically coupled to the ion funnel 46 via a number, P, of electrically conductive paths, where P may be any integer, and a voltage source 84 is electrically coupled to the circuit board 80 via a number, R, of electrically conductive paths, where R may be any positive integer. In the illustrated embodiment, the voltage source 84 illustratively includes at least one source of DC voltage and at least one source of radio frequency (RF) voltage. In one embodiment, the circuit components $82_1$-$82_Q$ illustratively include a sufficient number of resistors to connect between each of the electrodes $52_1$-$52_M$ and $56_1$-$56_N$, and the DC voltage source is configured to apply a suitable DC voltage between the electrodes $52_1$ and $56_N$ to establish an electric drift field within the drift regions 55, 57 in a direction that drives ions from the inlet 54 of the ion funnel 46 axially through the drift regions 55 and 57 and through the ion outlet of the ion funnel 46 (i.e., the aperture defined by the last ring electrode $56_N$ of the funnel region 50. The circuit components $82_1$-$82_Q$ further illustratively include a sufficient number of capacitors to connect between the RF voltage source(s) and each of the electrodes $52_1$-$56_N$, and the RF voltage source(s) is/are configured to apply a suitable RF voltage through a respective capacitor to each of the electrodes $52_1$-$56_N$, e.g., 180 degrees out of phase applied to adjacent electrodes, to radially focus the ions toward the axis A as the ions are driven axially through the drift regions 55, 57 by the DC drift field.

The FUNPET interface 20 further illustratively includes an ion carpet 58 spaced apart from the last ring electrode $56_N$ of the funnel region 50 of the ion funnel 46. The ion carpet 58 is illustratively conventional in construction and includes a series of concentric, or other closed-shape, electrically conductive rings 63 formed on one planar surface 60A of a planar substrate 60, e.g., a circuit board, nested about a central aperture 62 defined axially through the substrate 60. The rings illustratively all have the same thickness, and the inner diameters (or inner cross-sectional areas) of the rings increase sequentially in the direction radially away from the central aperture 62 such that a first one of the rings closely circumscribes the aperture 62 and each successive ring circumscribes the previous ring. In one embodiment, the circuit components $82_1$-$82_Q$ illustratively include a sufficient number of resistors to connect between each of the electrically conductive rings 63, and the DC voltage source is configured to apply a suitable DC voltage between the first and last rings to establish an electric drift field along the rings 63 in a direction that drives ions toward the aperture 62. In some embodiments, the circuit components $82_1$-$82_Q$ further illustratively include a sufficient number of capacitors to connect between the RF voltage source(s) and each of the rings 63, and the RF voltage source(s) is/are configured to apply a suitable RF voltage through a respective capacitor to each of the rings 63, e.g., 180 degrees out of phase applied to adjacent rings, to radially focus the ions toward the aperture 62. As ions driven axially through the drift regions 55, 57 exit the ion funnel 46, they are focused toward and through the aperture 62 of the ion carpet 58 by the DC drift field established between the rings 63 and, in some embodiments, also by the RF voltages applied to the rings 63. In some embodiments, only the DC drift field is used, and in other embodiments the RF voltage(s) may also be applied. Operation of the ion carpet 60 is thus conventional in that DC voltages, and in some embodiments RF voltages as well, are selectively applied to the rings 63 in a manner which focuses ions traveling perpendicularly toward the plane defined by the planar surface 60A of substrate 60, toward and through the aperture 62. In the embodiment illustrated in FIG. 1B, a central axis A extends axially through the aperture 62. The aperture 62 forms an ion outlet of the FUNPET interface 20 and thus also forms an ion inlet to the mass spectrometer 22.

The ring electrodes $52_1$-$52_M$ of the ion funnel 46 are illustratively joined to one another by electrically insulating, equal-width spacers. In one embodiment, such spacers are illustratively provided in the form of a continuous electrically insulating sheet $64_1$ on which the ring electrodes $52_1$-$52_M$ are formed or at least partially embedded, or to which the ring electrodes $52_1$-$52_M$ are affixed or otherwise attached, in spaced apart relationship as illustrated by example in FIG. 1B. Likewise, the ring electrodes $56_1$-$56_N$ are illustratively joined to one another by electrically insulating, equal-width spacers. In one embodiment, such spacers are illustratively provided in the form of a continuous electrically insulating sheet $64_2$ on which the ring electrodes $56_1$-$56_N$ are formed or at least partially embedded, or to which the ring electrodes $56_1$-$56_N$ are affixed or otherwise attached, in spaced apart relationship as also illustrated by example in FIG. 1B. In the illustrated embodiment, the continuous electrically insulating sheets $64_1$, $64_2$ are separate from one another, and in such embodiments the sheets $64_1$, $64_2$ are illustratively joined along their common boundary to form a seal such that the drift regions 55, 57 together define a single, sealed drift region extending axially through the ion funnel 46. In some such embodiments, as illustrated by example in FIGS. 6A and 6C, the electrically insulating sheet $64_2$, like the diameters of the apertures defined through the ring electrodes $56_1$-$56_N$, tapers downwardly so as to define a linearly (or non-linearly) decreasing outer diameter. In alternate embodiments, the continuous electrically insulating sheets $64_1$, $64_2$ may be combined to form a single sheet such that a single, unitary electrically insulating sheet is coupled to each of the ring electrodes $52_1$-$52_M$ and each of the ring electrodes $56_1$-$56_N$ along the length of the ion funnel 46 to similarly define a single, sealed drift region extending axially through the ion funnel 46. In any case, The axial gap between the last ring electrode $56_N$ of the funnel region 50 and the planar surface 60A of the ion carpet 58 facing the electrode $56_N$ illustratively defines a drift region 59 between the ion funnel 46 and the ion carpet 58 with the aperture 62 of the ion carpet 58 axially aligned, i.e., collinear, with the aperture defined by the inner diameter of the last ring electrode $56_N$. In the embodiment illustrated in FIG. 1B, the electrically insulating sheet $64_2$ is shown extending into sealing contact with the outer perimeter of the substrate of the ion carpet 58 or with the face 60A of the substrate 60 of the ion carpet 58 adjacent to its outer perimeter. In other embodiments, any suitable sealing material and/or structure may be used to form a seal between the ion carpet 58 and the ion funnel 46. In any case the ion carpet 58 is coupled in sealing engagement with and to the ion funnel 46 such that the cascaded combination of the drift region 55 of the constant-aperture region 48, the drift region 57 of the funnel region 50 and the drift region 59 defined between the funnel region 50 and the ion carpet 58 define a single, continuous and sealed drift region 65 extending axially through the ion funnel 46.

Figures 6A, 6B, 6C:
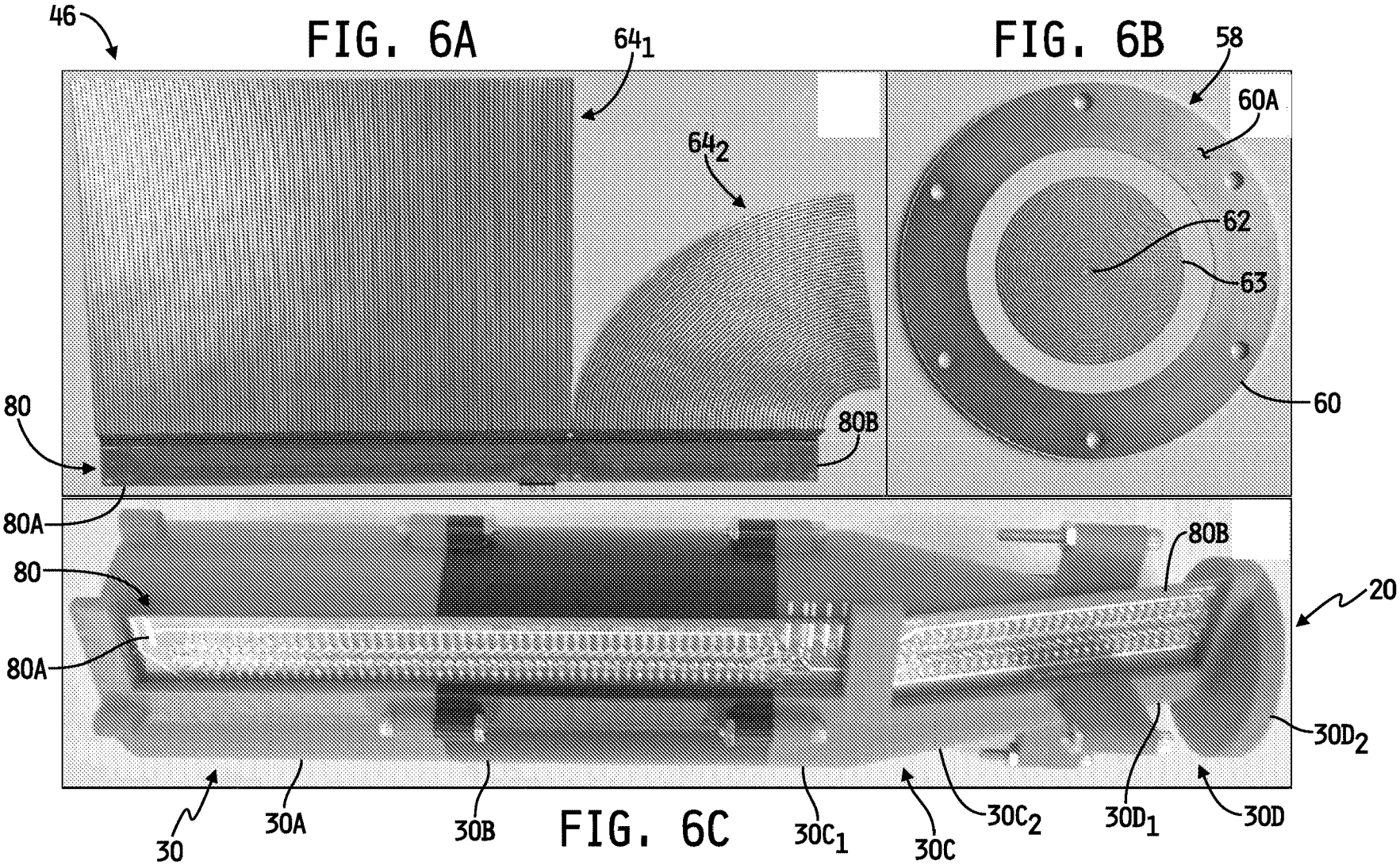
FIG. 6A is a plan view of an embodiment of the ion funnel of the FUNPET illustrated in FIG. 1B.
FIG. 6B is a plan view of an embodiment of the ion carpet of the FUNPET illustrated in FIG. 1B.
FIG. 6C is a plan view of an embodiment of an assembly of the FUNPET interface of FIG. 1B using the components illustrated in FIGS. 6A and 6B.

Referring now to FIGS. 6A-6C, a physical embodiment of FUNPET Interface 20 of FIG. 1B is shown. As illustrated by example in FIG. 6A, the ion funnel 46 of the FUNPET interface 20 is illustratively made of two electrically insulating, flexible printed circuit board (PCB) sheets $64_1$ and $64_2$. The electrodes $52_1$-$52_M$ are mounted to or formed on the electrically insulating sheet $64_1$ in the form of a series of elongated, side-by-side, spaced apart electrically conductive strips which form an axial sequence of spaced-apart, electrically conductive, constant aperture ring electrodes $52_1$-$52_M$ when the sheet $64_1$ is formed into a cylinder as illustrated in FIG. 1B. The electrodes $56_1$-$56_N$ are mounted to or formed on the electrically insulating sheet $64_2$ in the form of a series of arcuate, side-by-side, spaced apart electrically conductive strips which form an axial sequence of spaced-apart, electrically conductive, decreasing aperture ring electrodes $56_1$-$56_N$ when the sheet $64_2$ is formed into a funnel as illustrated in FIG. 1B. As also illustrated in FIG. 6A, the circuit board 80 is shown electrically connected to the ion funnel 46. In this embodiment, the circuit board 80 is provided in the form of two separate, elongated circuit boards 80A, 80B that are coupled together at adjacent ends. Some of the circuit components $82_1$-$82_Q$ are mounted to the circuit board 80A and are electrically and operatively coupled to the constant aperture diameter ring electrodes $52_1$-$52_M$ mounted to the sheet $64_1$, and others of the circuit components $82_1$-$82_Q$ are mounted to the circuit board 80B and are electrically and operatively coupled to the constant aperture diameter ring electrodes $56_1$-$56_N$ mounted to the sheet $64_2$.

As illustrated by example in FIG. 6B, the ion carpet 58 of the FUNPET interface 20 is provided in the form of a rigid, electrically insulating printed circuit board (PCB) 60 having a planar face 60A to which a number of nested, electrically conductive rings 63 is mounted or otherwise formed. The electrically conductive ring with the smallest inner diameter surrounds an aperture 62 defined centrally through the circuit board 60, and each of the remaining electrically conductive rings 63 sequentially circumscribe each other to form the ion carpet structure. The ion carpet 58 may include any number of nested, electrically conductive rings 63, and in the embodiment illustrated in FIG. 6B the ion carpet 58 illustratively has 25 nested rings 63.

As further illustrated by example in FIG. 6C, the ion funnel 46 and the ion carpet 58 are held in place in their operative positions illustrated in FIG. 1B by a 3D printed ABS plastic support housing 30 such that the ion funnel 46 and the ion carpet 58 are sealed as described above with respect to FIG. 1B. In the illustrated embodiment, the support housing 30 includes four sections 30A-30D which are bolted together to form the FUNPET interface 20. The sections 30A and 30B contain most of the rolled sheet $64_1$ which defines the constant-aperture region 48 of the ion funnel 46. The sub-section $30C_1$ of the section 30C contains the remainder of the rolled sheet $64_1$ and the sub-section $30C_2$ of the section 30C contains most of the rolled sheet $64_2$ which defines the funnel region 50 of the ion funnel 46. The sub-section $30D_1$ of the section 30D contains the remainder of the rolled sheet $64_2$ and the sub-section $30D_2$ of the section 30D illustratively forms a disk section sized to house the ion carpet 58. The circuit board 80A is coupled to the sections 30A-30C of the housing 30 and rides along outer surfaces of these sections. The circuit board 80B is coupled to the sections 30C and 30D of the housing 30 and likewise rides along outer surfaces of these sections. Some of the circuit components $82_1$-$82_Q$ mounted to the circuit board 80B are electrically and operatively coupled to the electrically conductive rings 63 mounted to the circuit board 60 defining the ion carpet 58.

In the illustrated embodiment, ions C generated by the ESI source 18 enter the vacuum chamber 30 and are directed by a gas flow 70, resulting from the pressure differential between the ESI source 18 operating at atmospheric pressure and the mass spectrometer 22 operating under vacuum conditions, into the ion inlet 54 of the constant-aperture drift region 48 of the sealed drift region 65. As the gas flows deeper into the drift region 48 and funnel region 50, back pressure develops and increases, which slows the gas flow 70 and eventually creates an area of built-up pressure 72 which causes a counterflow of gas 74 back toward and out of the ion inlet 54 of the ion funnel 46. The combination of the area 72 of pressure build-up and the counterflow 74 of gas, as a direct result of the sealed ion funnel 46, creates a virtual jet disrupter 76 which dissipates the gas flow jet and thermalizes the ions C. One or more of the valves 34, 40, and 44 may illustratively be controlled to adjust the features of, and operating parameters associated with, the pressure build-up area 72 and the counterflow 74 of gas within the ion funnel 46. The combination of the tapered drift region 57 and the ion carpet 58, along with suitable electrical control thereof using conventional RF and DC voltage sources 84, illustratively steers the thermalized ions C toward and through the ion outlet aperture 62 of the FUNPET interface 20. Control and operation of the FUNPET Interface 20 is further described below with respect to FIGS. 5-8.

It should be appreciated that a mass spectrometer 22 may be of any conventional design including, for example, but not limited to a time-of-flight (TOF) mass spectrometer, a reflectron mass spectrometer, a Fourier transform ion cyclotron resonance (FTICR) mass spectrometer, a quadrupole mass spectrometer, a triple quadrupole mass spectrometer, or the like. Moreover, in some embodiments, the source of ions entering the FUNPET interface 20 may alternatively be any conventional source of ions including for example, but not limited to, one or any combination of at least one ion generating device such as an electrospray ionization source as described with respect to FIG. 1B, a matrix-assisted laser desorption ionization (MALDI) source or the like, and may further include one or more molecular separation instruments configured to separate ions over time as a function of at least one molecular characteristic, such as an ion mobility spectrometer, a liquid or gas chromatograph, or the like.

Referring now sequentially to FIGS. 2A-2F, FIGS. 3A-3F and FIGS. 4A-4F, structures and operation of three alternate ion source interfaces are shown having components different from the FUNPET interface 20 illustrated in FIG. 1B and described above. To achieve results shown in FIGS. 2A-4F, certain gas flow simulations, diffusion, and ion trajectory simulations have been conducted. Following the description of these alternate interfaces with reference to FIGS. 2A-2F, FIGS. 3A-3F and FIGS. 4A-4F, simulation results for the FUNPET 20 described above are shown and will be described with reference to FIGS. 5A-5F.

A first alternate interface ("Interface 1") illustrated in FIGS. 2A-2F has an open drift region with a physical jet disruptor and an ion carpet but no ion funnel. A second alternate interface ("Interface 2") illustrated in FIGS. 3A-3F has a sealed drift region with an ion carpet but no physical jet disruptor and an ion funnel. A third alternate interface ("Interface 3") illustrated in FIGS. 4A-4F has a sealed drift region with a virtual jet disrupter and an ion funnel but no ion carpet. The FUNPET Interface 20 illustrated in FIGS. 4A-5F has, as described with respect to FIG. 1B, a sealed drift region 65 defined within an ion funnel 46 and coupled to an ion carpet 62, wherein the sealed drift region 65 defines a virtual jet disrupter 76 therein.

Gas Flow Simulations

The characterization of the gas entering the interface began with understanding the gas flow through the heated metal capillary (10 cm long, 0.381 mm ID) which was the same for all four interfaces. Due to the large pressure difference across the capillary, a flow exiting the capillary is forms a supersonic jet. The volume flow through the capillary was calculated using the Wutz/Adams turbulent model which has been shown to agree well with experiments if the capillary length to diameter ratio is sufficiently large (e.g., >50). Gas flow simulations were conducted to determine the properties of the capillary jet and understand how the capillary jet is affected by each interface. The results from the gas flow simulations were then imported into the ion trajectory program to understand the effect of gas flow on both ion transmission and the ions' excess kinetic energy. Two methods were used to model gas flow, the choice depending on the gas density.

The low background pressure (e.g., 93 Pa) of the open drift region of Interface 1 was best suited for analysis by the Direct Simulation Monte Carlo method (DSMC) program, DS2V, though the inlet pressure was too high to be modeled directly. Therefore, to model inlet conditions accessible by the DS2V program, the flow inlet diameter was approximated using the maximum barrel shock diameter of the jet expansion that was calculated for the capillary. All simulations of the open drift region used a 2D axisymmetric model of the region, where the gas was treated as hard spheres with diffuse reflection from all surfaces. The initial state of the system was vacuum, and exit boundaries were set at the carpet aperture and the pumping location downstream from the capillary. The DS2V simulation of the open drift region of Interface 1 was run until the flow reached a steady state.

The pressure build up that occurred for the closed drift regions of Interface 2, Interface 3, and FUNPET Interface 20 led to simulation times for the DSMC method that were too long. To more accurately model the higher density gas in the closed interface designs, a continuum based solver was used. In this work, Star-CCM+v10.06 (CD-Adapco) was used for all closed interface simulations. Solver settings were chosen for compressible flow of an ideal gas. Pressure outlets were set for the region behind the capillary (93 Pa) and at the exit aperture (10 Pa) of each interface design. The initial pressure inside the closed drift region was set at 93 Pa (based on the measured pressure for a similar configuration in previous instruments). Convergence was judged to have occurred when the exit mass flow rate equaled the entrance mass flow rate (±5%).

Diffusion

Diffusion was incorporated with the Langevin dynamics model as adapted by Crooks and co-workers into a velocity Verlet algorithm. Langevin dynamics adds two additional force terms to Newton's second law of motion to account for a particle's dampened motion due to friction (i.e. drag) and a random force representing stochastic collisions with a fictitious background gas (i.e. diffusion). In this work, the diffusion coefficient was calculated with the Einstein relation and the ion's mobility was calculated with the Mason-Schamp equation. The seven-step velocity Verlet algorithm developed by Crooks and coworkers is given by, $$v\left(n+\frac{1}{4}\right)=\sqrt{a}\,v(n)+\sqrt{\frac{1-a}{\beta m}}\,N^{+}(n) \tag{1}$$

$$v\left(n+\frac{1}{2}\right)=v\left(n+\frac{1}{4}\right)+\frac{b\Delta t}{2}\frac{f(n)}{m} \tag{2}$$

$$r\left(n+\frac{1}{2}\right)=r(n)+\frac{b\Delta t}{2}v\left(n+\frac{1}{2}\right) \tag{3}$$

$$H(n)\rightarrow H(n+1) \tag{4}$$

$$r(n+1)=r\left(n+\frac{1}{2}\right)+\frac{b\Delta t}{2}v\left(n+\frac{1}{2}\right) \tag{5}$$

$$v\left(n+\frac{3}{4}\right)=v\left(n+\frac{1}{2}\right)+\frac{b\Delta t}{2}\frac{f(n+1)}{m} \tag{6}$$

$$v(n+1)=\sqrt{a}\,v\left(n+\frac{3}{4}\right)+\sqrt{\frac{1-a}{\beta m}}\,N^{-}(n+1) \tag{7}$$

The variables r and v are the particle's position and velocity, n is the current time, Δt is the time step, f represents the drag force acting on the particle, m is the particle mass, β is the inverse of $k_BT$ (where $k_B$ is Boltzmann's constant and T is temperature) and a represents the dampened velocity due to drag. $N^+$ and $N^-$ are independent, standard normal deviates, and are used to model the stochastic motion of the particle. The variable b is a scaling factor used to ensure the accuracy of this model. Step 4 is an explicit Hamiltonian update. For the simulation work presented herein, the Hamiltonian step was omitted, and the scaling factor was determined to be unnecessary due to the already small time step of the simulation. In addition, the dampened velocity term was omitted in favor of incorporating the drag force (see below) directly into the force term present in steps 2 and 6. This is because the dampened velocity term assumes a static background gas, whereas our drag model incorporates a flowing background gas. Simulations demonstrated good agreement between the two drag models.

This model was tested against a simple Monte Carlo diffusion simulation to determine its accuracy. The final positions of a large group of diffusing particles for a large number of time steps were recorded, and the distributions were compared. At long time-scales, large ion mass and high background pressure, both models gave the expected Gaussian distribution of final positions. At short time-scales, small ion mass and low pressure, the Langevin Dynamics model deviated away from the Gaussian distribution created by the Monte Carlo method. However, this is to be expected, as a large number of collisions are needed to create a Gaussian distribution of final positions, and shorter times, lighter mass, and lower pressure all result in fewer collisions. This diffusion model was therefore deemed appropriate.

Ion Trajectory Simulations

The ion trajectory simulations were performed using a velocity Verlet algorithm that incorporated a Langevin dynamics diffusion model, gas flow information through a drag model, forces from electric fields from SIMION 8.1, and gravity. This was all incorporated into a custom Fortran program written using OpenMP directives so that thousands of ions could be analyzed in a timely manner. In addition to determining the fraction of incident ions that are transmitted, the ion energy is tracked to ensure that the ions are thermalized.

The first step is to write and refine a SIMION geometry file. DC and RF potentials were applied to all electrodes, and potential array files were printed out. Local gas pressure and velocity information are extracted from the DS2V or Star-CCM+ simulations and a lookup table created. The trajectory calculation begins by initializing the ion's position. For interfaces with a diverging nozzle, all ions start at the same axial position, with a random radial position. The ion's initial velocity is set equal to that of the surrounding gas flow, as it is expected that all ions will be moving with the gas flow towards the end of the capillary. Once the ion position and velocity have been set, the trajectory simulation begins.

At each time step, a bi-linear interpolation for the gas flow values and a tri-linear interpolation for the electric field values are performed for the ion's location. The ion's velocity is calculated relative to that of the surrounding gas flow, then this relative velocity and the pressure of the surrounding gas is used to calculate a drag force, which is then converted to an acceleration using the ion's mass. The acceleration due to this electric field is then calculated. The total acceleration is then determined by summing the contributions from drag, the electric fields, and gravity. The diffusion constant is determined from the local pressure and incorporated into the diffusion model and a position and velocity update due to the diffusion is obtained. The ion's position is then updated based on its current velocity, the total acceleration due to the electric fields, drag, gravity, and diffusion. The ion velocity is then updated in a similar manner, the total velocity is calculated and the ion energy is determined. The program then records the ion's position and energy, checks to see if the ion has crashed out on an electrode or been successfully transmitted and if not, the cycle is repeated. Once all ions have either crashed out or been transmitted, the percent transmission and for the transmitted ions, the average final energy and standard deviation of the average final energy are calculated for each ion mass studied.

Referring now to FIGS. 2A-2F, Interface 1 having an open drift region with an ion carpet (illustrated in vertical lines on the right-hand side) and a physical jet disruptor (illustrated as a central vertical line within the drift region) is shown. In one illustrative example of this interface, the drift region is composed of 74 ring electrodes (illustrated in vertical lines) with a constant inner diameter of 2.54 cm. The electrodes are 0.508 mm thick with 3.81 mm spacing between them, for a total length of 31.57 cm. RF signals, 300 V peak-to-peak ($V_{pp}$) and 180° out of phase, are applied to adjacent electrodes. A constant drift gradient of 5 V/cm is also applied. A 6.35 mm diameter jet disruptor is placed halfway down the length of the drift region. The ion carpet is placed 6.35 mm from the end of the drift region. The carpet is composed of 24 concentric ring electrodes 0.254 mm high, 0.381 mm wide, and spaced by 0.127 mm. The exit aperture in the center of the ion carpet is 1.016 mm long with a 1.016 mm diameter. A non-linear DC voltage gradient is applied to the ion carpet, with the innermost electrode grounded and the outer three electrodes all held at 274 V. The voltage gradient is steeper near the exit aperture. No RF is applied to the ion carpet. It will be understood that the numerical dimensions and other numerical features described in the paragraph are provided only by way of example, and should not be considered limiting in any way. Alternate embodiments are contemplated in which one or more such numerical dimensions and/or other numerical features may be greater or lesser than those described above by example.

Figures 2A, 2B, 2C, 2D, 2E, 2F:
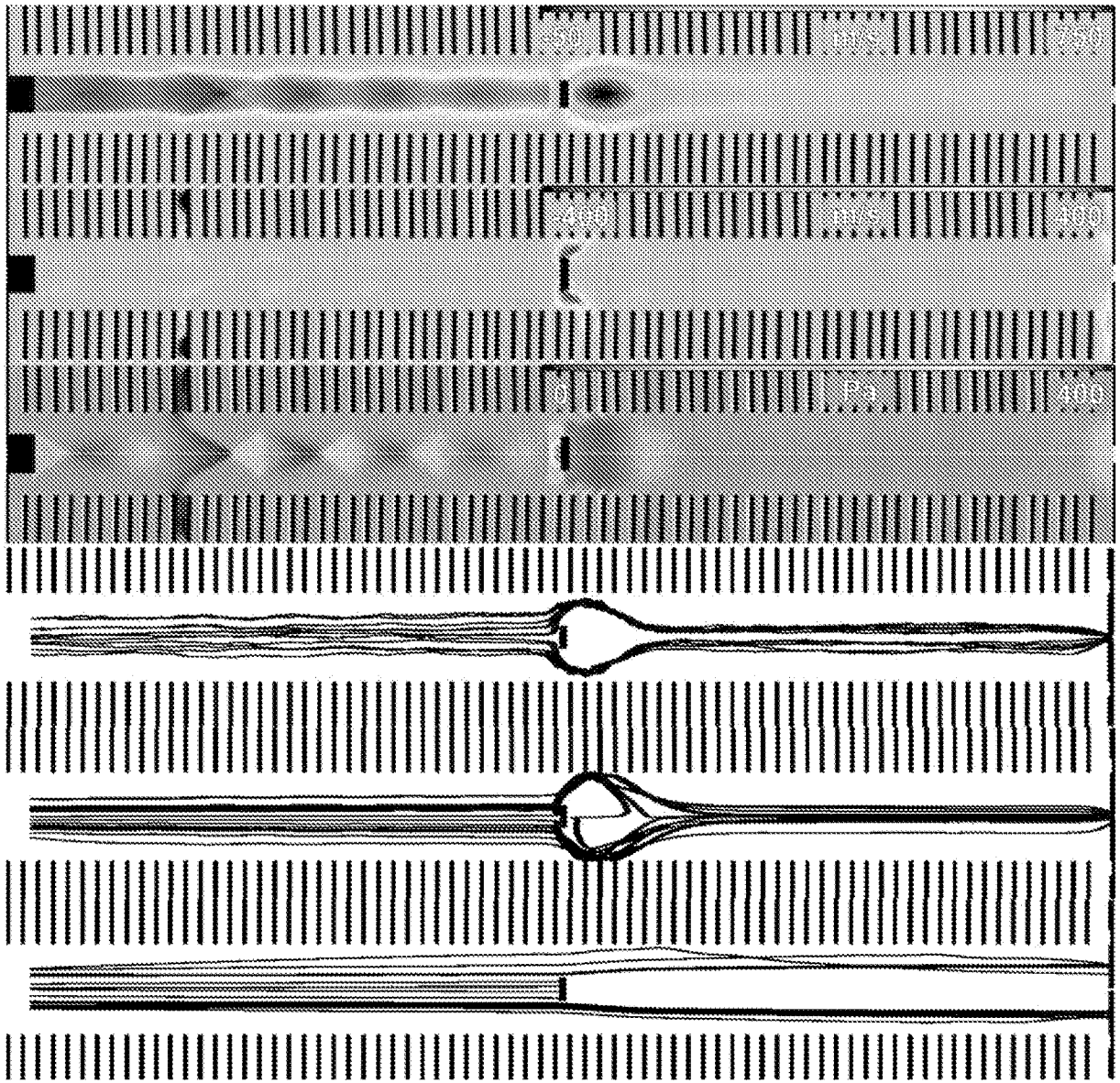
FIGS. 2A-2F illustrate gas flow and ion trajectories for an example ion source interface having an open drift region with a physical jet disruptor positioned therein.

The low pressure in the open drift region is suitable for DSMC analysis. For example, as illustrated in FIG. 2A, the axial velocity from the DS2V simulation shows that the jet disruptor does mostly stop the jet. Some gas is seen to flow around the jet disruptor where it then recombines and flows towards the pumping and carpet apertures located at the end of the drift region. However, the pressure is lower here, allowing a larger radial expansion. As illustrated in FIG. 2B, the radial velocity shows a large value just before the jet disruptor and then a negative value as the flow recombines after the jet disruptor. It should be also noted that the positive radial velocity at the carpet wall showing that the gas flow is colliding with the wall. The local pressure illustrated in FIG. 2C shows that most of the drift region is centered on the expected 93 Pa, with the exception of the area immediately before the jet disruptor.

Ion trajectories using different sized ions for this device are shown in FIGS. 2D-2F. For example, twenty representative trajectories are shown for 1 kDa, 1 MDa, and 1 GDa in FIGS. 2D-2F, respectively. As shown in FIG. 2D, 1 kDa ions travel around the jet disruptor, the ions are refocused to the central axis by a gas flow and then focused by the ion carpet at the end of the open drift region. As the mass of the ions increases, the ions are no longer thermalized and are lost on the surface of the jet disruptor. The diffusion coefficient is inversely proportional to the mass, which means that the effect of diffusion can be seen more easily for the smaller ions.

Referring now to FIGS. 3A-3F, Interface 2 having a sealed drift region with an ion carpet (illustrated in blue vertical lines on the right-hand side) is shown. In this interface, the layout of the drift region and the ion carpet are similar to the drift region and the ion carpet of Interface 1 in FIGS. 2A-2F but with insulator sealing gaps between the electrodes (illustrated in black vertical lines). In addition, Interface 2 does not include a physical jet disruptor. Instead, the gas flow itself is used as a virtual jet disruptor by sealing the electrodes of the drift region. In doing so, a pressure is built-up at the carpet end of the sealed drift region, and the counter flow of gas out of the drift region helps to dissipate the jet and thermalize the ions. By sealing the drift region, the local pressure rises so that the continuum assumption is appropriate for gas flow calculations. In Interface 2, a diverging nozzle was used to reduce the radial expansion of the jet.

RF signals, 300 $V_{pp}$ and 180° out of phase, are applied to adjacent electrodes. In one illustrative example, a non-linear voltage gradient is applied to the sealed drift region, with the first 15.5 cm having 40 V/cm, the last 11 cm having 0.5 V/cm gradient and the middle 5 cm decreasing linearly from 40 V/cm to 0.5 V/cm. In addition, the voltage gradient applied to the ion carpet is 10% of the gradient used above for Interface 1. Finally, to reduce the radial expansion of the jet, a 1 cm long diverging nozzle (0.75 mm ID to 5 mm ID) was added to the end of the capillary inlet. The end of the nozzle protrudes 2 cm into the drift region. Diverging nozzles are known to increase the centerline intensity. It will be understood that the numerical dimensions and other numerical features described in the paragraph are provided only by way of example, and should not be considered limiting in any way. Alternate embodiments are contemplated in which one or more such numerical dimensions and/or other numerical features may be greater or lesser than those described above by example.

Figures 3A, 3B, 3C, 3D, 3E, 3F:
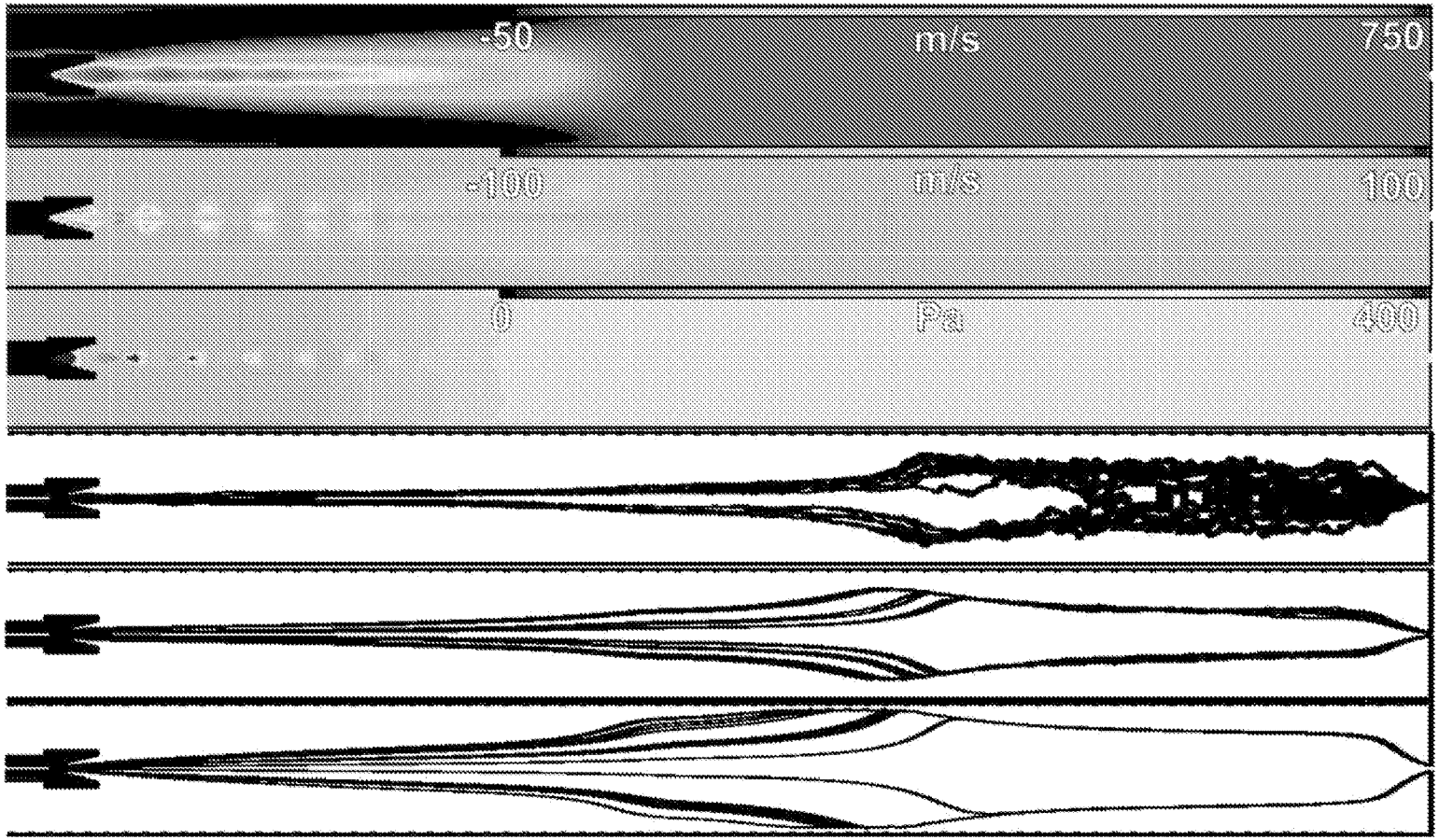
FIGS. 3A-3F illustrate gas flow and ion trajectories for another example ion source interface having a sealed drift region but no physical jet disrupter therein.

Referring to FIG. 3A, the axial velocity for the closed drift region shows that the jet is stopped ~15 cm from the capillary inlet. As a result, the local pressure at the carpet end rises to around 280 Pa (see FIG. 3C), and the counter flow of gas around the jet. It is the combination of the counter flow and the pressure build-up at the carpet end of the drift region that provides the virtual jet disruptor that breaks-up the jet and allows the ions to be thermalized. The performance of the virtual jet disruptor is enhanced by keeping the diameter of the drift region relatively small. Without the physical jet disruptor, the radial velocity, shown in FIG. 3B, is significantly less than with Interface 1. The only notable radial velocity features are the expansion and compression of the under-expanded jet exiting the diverging nozzle.

A disadvantage of the pressure build-up at the carpet end of the drift tube is that it increases the gas load on subsequent regions of the mass spectrometer. Because of the pressure build-up, the drift gradient on the first 15 cm of the drift region was increased to 40 V/cm. Increasing the drift field reduced the time that the ions have to diffuse, preventing them from getting caught in the counter flow and lost. At the carpet end of the drift region the gas is near-static and the drift field was reduced to 0.5 V/cm. The voltage gradient on the ion carpet was reduced to 10% of what it was in Interface 1. Lowering these voltage gradients reduces the ions' excess kinetic energy. It will be understood that the numerical dimensions and other numerical features described in the paragraph are provided only by way of example, and should not be considered limiting in any way. Alternate embodiments are contemplated in which one or more such numerical dimensions and/or other numerical features may be greater or lesser than those described above by example.

FIGS. 3D-3F show exemplary trajectories for 1 kDa, 1 MDa, and 1 GDa ions. For all ion masses, a radial expansion occurs in the latter portion of the drift region due to the change in the potential gradient and the gas flow where a radial component results because the flow is transitioning from axial flow towards the carpet to counter flow along the edge of the drift region. The potential gradient becomes weaker at the carpet end creating a field component orthogonal to the axis.

The transmission for Interface 2 is close to 100% for all ion masses between 10 kDa and 100 MDa (see FIG. 3A); a dramatic improvement over Interface 1. With the reduced drift field at the carpet end of the drift region in interface 2, and the absence of a significant gas flow diffusion plays a much greater role, particularly for the small, low-mass ions. Diffusion causes some of the ions to be lost on the surface of the carpet. This is responsible for the reduced transmission efficiency of the 1 kDa ions (see FIG. 3B). This was confirmed by re-running the ion trajectory simulations for the 1 kDa ions without diffusion, and transmission of 100% was achieved. However, diffusion is not responsible for the poor transmission efficiency of the 1 GDa ions. Here the issue is their large radial expansion and the difficulty of focusing them with the ion carpet.

In addition to the greatly improved ion transmission, the ions' average excess kinetic ion energy was much improved as well. The excess kinetic energy dropped by approximately a factor of 35 for all ion masses, as shown in FIG. 3B. However, ion energy for the few transmitted 1 GDa ions still exceeds 10 keV, and lowering any of the voltage gradients only further reduces transmission. While much improved, the average ion energy is still higher than desired.

Low transmission of high mass ions in the Interface 2 results from the carpet being not very effective at focusing ions that are a long way off-axis. In an effort to increase transmission of high mass ions, Interface 3 has been designed to incorporate an ion funnel along with a virtual jet disruptor instead of a physical one. Thus, the ion funnel has a relatively long and narrow drift region that is sealed so that an effective virtual jet disruptor can be generated by the gas flow and counter flow.

Referring now to FIGS. 4A-4F, Interface 3 having a sealed ion funnel with a virtual jet disruptor is shown. Interface 3 is an ion funnel illustratively composed of a series of square ring electrodes. In one illustrative embodiment, the Interface 3 is made out of eight rigid PCBs: four rectangular boards for the straight drift region and four triangular boards for the funnel region. The square ring electrodes are 0.635 mm in width with 0.635 mm spacing between adjacent electrodes, for a total electrode pitch of 1.27 mm. The straight drift region is composed of 204 electrodes, for a total length of 26 cm, with an inner diameter of 7.62 cm. The final 104 electrodes taper down to a 2 mm inner diameter exit aperture, for a full funnel length of 42 cm. RF signals, 300 V peak-to-peak (Vpp) and 180° out of phase, are applied to adjacent electrodes, as with Interfaces 1 and 2 above. However, the final four electrodes are not supplied with RF. A constant drift gradient of 5 V/cm is applied across the entire funnel. Finally, the diverging nozzle inlet protrudes 3 cm into the ion funnel. It will be understood that the numerical dimensions and other numerical features described in the paragraph are provided only by way of example, and should not be considered limiting in any way. Alternate embodiments are contemplated in which one or more such numerical dimensions and/or other numerical features may be greater or lesser than those described above by example In order to reduce the gas flow from the interface into subsequent regions of the mass spectrometer, the inner diameter of the ion funnel was increased compared to Interfaces 1 and 2. Additionally, Interface 3 has a longer the drift region compared to Interfaces 1 and 2 because the jet takes longer to dissipate with the increased diameter.

Figures 4A, 4B, 4C, 4D, 4E, 4F:
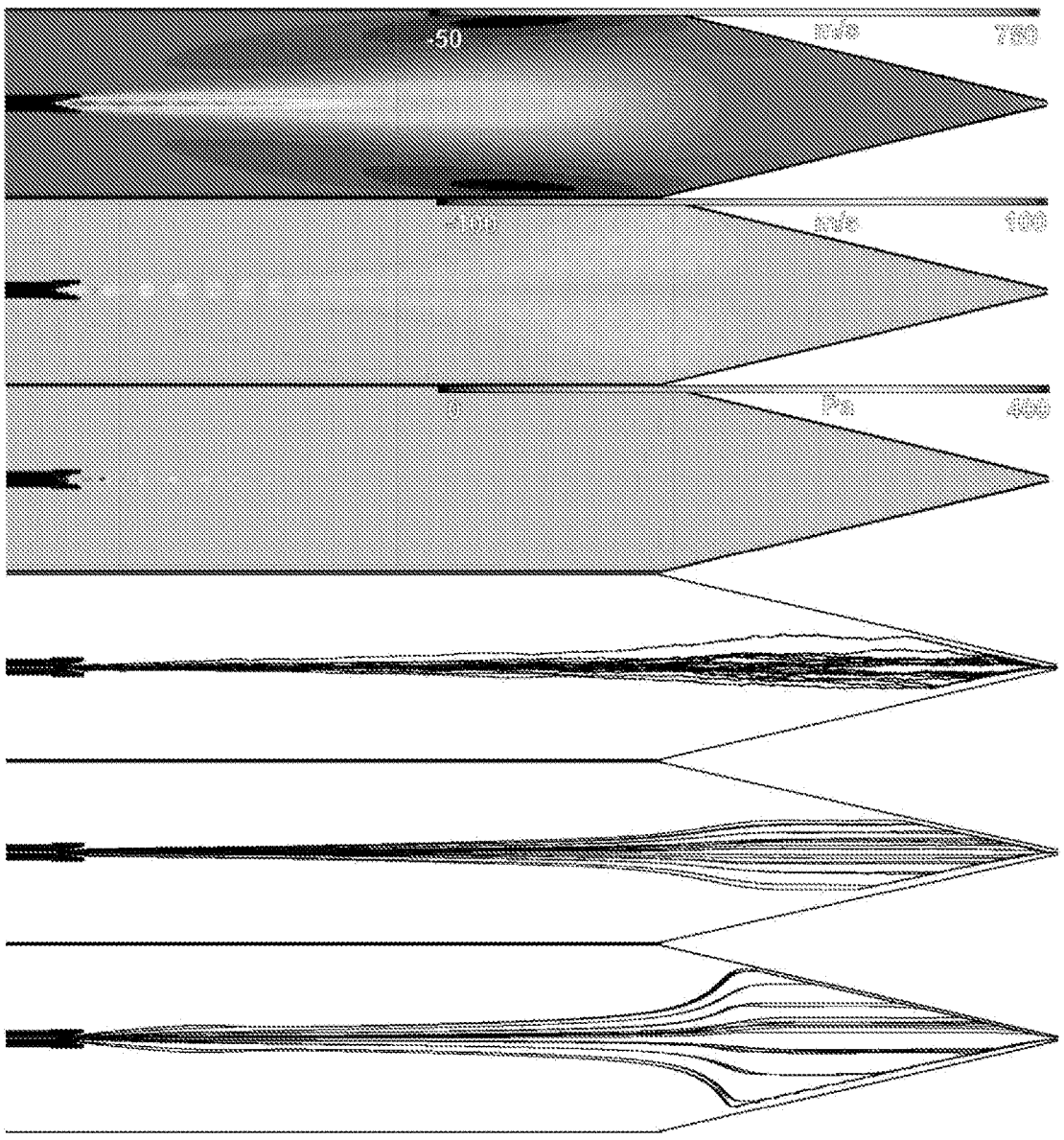
FIGS. 4A-4F illustrate gas flow and ion trajectories for yet another example ion interface similar to the FUNPET interface illustrated in FIG. 1B having a sealed drift region with a virtual jet disrupter therein and an ion funnel, but without an ion carpet at an ion outlet thereof.

In FIG. 4A, the gas flow axial velocity for the ion funnel shows the jet stopped ~27 cm away from the capillary inlet (around twice as far as in Interface 2). The radial velocity (FIG. 4B) shows the same radial velocity features as seen for Interface 2 (resulting from expansion and compression of the under-expanded jet). The pressure build-up near the exit of the funnel is close to 195 Pa (compared to 280 Pa with Interface 2) (FIG. 4C). The lower pressure build-up is due to the larger diameter and this leads to the longer jet stopping distance noted above.

The combination of the small aperture (1 mm diameter) and RF field creates axial wells that trapped the small ions and lowered transmission. As a result, the aperture was increased to 2 mm diameter and the RF potential was removed from the last four funnel electrodes to allow more ions to be transmitted. The decreased pressure in the ion funnel is configured to reduce the gas load on the next region; however, the 2 mm ID aperture results in a mass flow rate out the exit aperture ($1.48\times10^{-7}$ kg/s) greater than that of the higher pressure drift region in Interface 2 ($6.68\times10^{-8}$ kg/s). Because of the larger inner diameter it was possible to use a constant 5 V/cm drift gradient along the entire funnel. Lowering this gradient any further does not decrease the excess ion energy, as this is primarily set by the gas flow through the exit aperture.

Sample ion trajectories are shown in FIGS. 4D-4F. As the ions encounter the nearly static background gas towards the latter portion of the funnel, the ions radial distribution expands, but the ions are now confined and focused by the funnel. Near 100% transmission was achieved for the entire mass range studied (see FIG. 9A). FIG. 9B shows that low excess kinetic energies were achieved for ion masses of 1 MDa and below. However, for masses greater than 10 MDa, the excess kinetic energy is higher than with Interface 2. This demonstrates that it is primarily the gas flow out of the aperture that sets the ion kinetic energy with this interface. Heavier ions have larger collisional cross-sections and thus undergo more collisions with the gas flowing out of the aperture.

The results for Interface 3 show that the problem with the transmission of the off-axis high mass ions observed with Interface 2 has been fixed with the funnel geometry. However, the exit aperture of the funnel was found to induce ion traps. To avoid ion traps, the diameter of the aperture was increased, which resulted in a large mass flow rate that accelerated the ions and led to large excess kinetic energies for the high mass ions. The carpet can have a small exit aperture, but the problem with the carpet is that it struggles to transmit ions that are a long way off axis. To transmit these ions, high voltage gradients on the carpet was increased and this contributed to the ions' excess kinetic energy. It was then determined that a combination of a funnel and carpet may capture favorable features from both types of interface: a funnel to focus ions with a large radial extent and a carpet with a small aperture to transmit them.

Referring now to FIGS. 5A-5F, the FUNPET interface 20 illustrated in FIG. 1B has a virtual jet disruptor as shown. The illustrated FUNPET interface 20 is a combination of the sealed drift region-ion carpet and ion funnel interfaces. In the illustrative embodiment, a circular funnel with a 2.54 mm electrode pitch tapers down to a 6.35 mm inner diameter, with a 6.35 mm diameter ion carpet placed 1.27 mm from the last electrode of the ion funnel. 300 $V_{pp}$ RF signals are applied, though now all funnel electrodes are supplied with RF. A non-linear drift gradient is again used, where the first 30.5 cm has a gradient of 5 V/cm, the final 5 cm has a gradient of 1 V/cm, and the intervening 4 cm has a gradient that decreases linearly from 5 V/cm to 1 V/cm. Additionally, the ion carpet has a voltage gradient that is 4% of that of value used in Interface 1—just 12 V across the entire structure. As in the previous ion funnel simulation, the capillary-diverging nozzle inlet protrudes 3 cm into the interface.

Figures 5A, 5B, 5C, 5D, 5E, 5F:
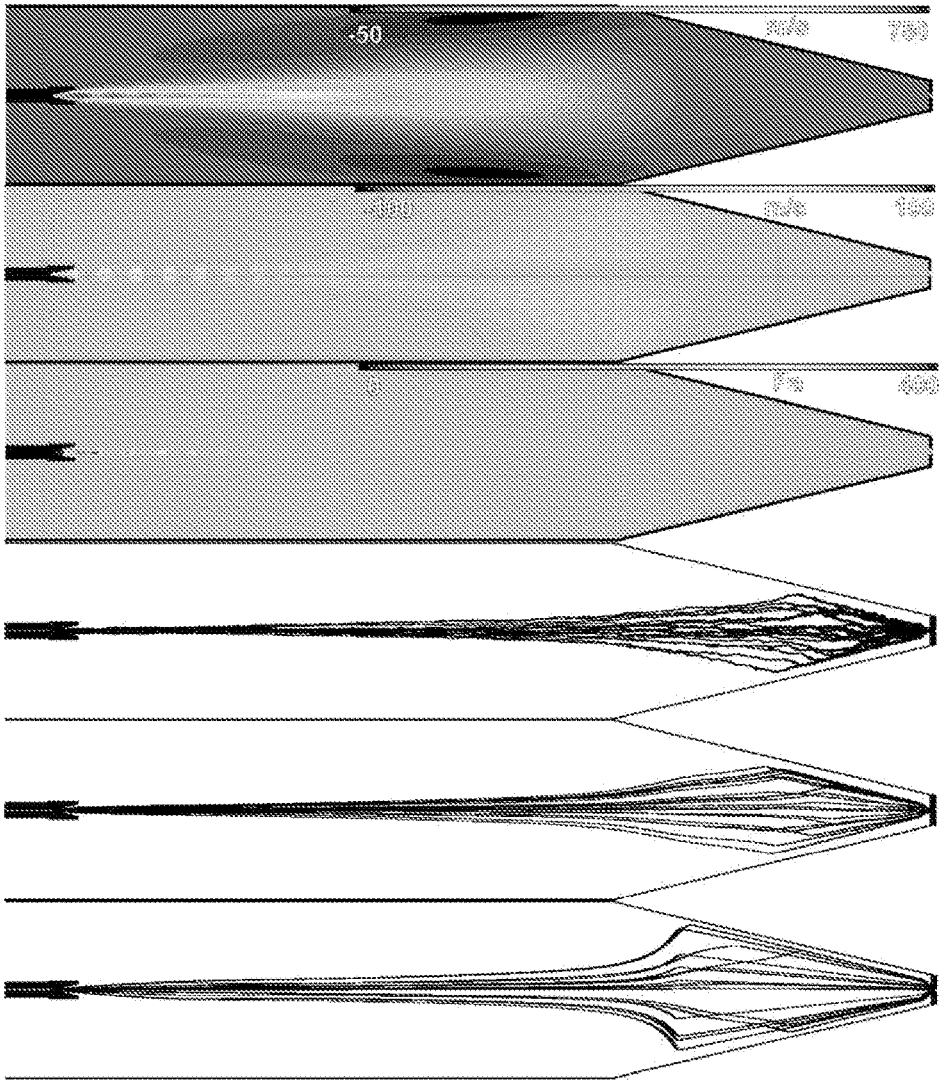
FIGS. 5A-5F illustrate gas flow and ion trajectories for the FUNPET Interface illustrated in FIG. 1B having a sealed drift region with a virtual jet disrupter therein and an ion funnel and with an ion carpet at an ion outlet thereof.

The axial and radial velocities for the FUNPET device, shown in FIGS. 5A and 5B, respective, closely resemble that of the ion funnel device, with the jet being stopped ~27 cm away from the capillary exit. The pressure build-up in the FUNPET device is approximately 1 Pa greater than Interface 3, but the smaller aperture associated with the carpet leads to a mass flow rate exiting through the FUNPET aperture of $1.94\times10^{-8}$ kg/s, which is much lower than in Interfaces 2 and 3. The ion trajectories shown in FIGS. 5D-5F are similar to those for Interface 3. It will be understood that the numerical dimensions and other numerical features described in with respect to FIGS. 5A-5F are provided only by way of example, and should not be considered limiting in any way. Alternate embodiments are contemplated in which one or more such numerical dimensions and/or other numerical features may be greater or lesser than those just described above by example.

The transmission and excess ion energies shown in FIG. 9 demonstrate that FUNPET Interface 20 is the best performing interface device examined here. Nearly 100% transmission was achieved across the entire mass range, with only 1% of the 1 kDa ions crashing out on the surface of the ion carpet due to diffusion. The high transmission efficiencies were achieved with minor adjustment to the RF frequency: a frequency of 250 kHz was employed in the 1 kDa simulations, and a frequency of 100 kHz was used for all other masses. The FUNPET interface 20 transmits 100% of ions in the range of 10 kDa to 1 GDa with the same voltages and RF frequencies. In addition, the FUNPET interface 20 provided the lowest excess kinetic energies. While the three lightest masses have approximately the same excess kinetic energy as they did with Interface 3, the heavier ions have much lower excess kinetic energy. For example, for 1GDa ions, the excess kinetic energy from the FUNPET interface 20 is more than four time lower than with Interface 3. This again emphasizes how the heavier ions are more strongly affected by the gas flow. The FUNPET interface 20 has the lowest mass flow rate and thus the large ions have the lowest excess kinetic energies.

The FUNPET interface 20 illustrated in FIGS. 6A-6C was installed on a home-built charge detection mass spectrometer (CDMS) similar to that described previously. Ions were generated using a chip-based nano-electrospray source (Advion Triversa NanoMate), and entered the FUNPET interface 20 through a heated metal capillary (10 cm long, 0.381 mm ID) equipped with a diverging nozzle (1 cm long diverging from 0.75 mm ID to 5 mm ID). After the FUNPET interface 20, ions were confined by an RF hexapole, followed by an RF quadrupole. Ions exiting the quadrupole were focused by an Einzel lens to be transmitted through a set of ion deflectors into a dual hemispherical deflection analyzer (HDA) set to transmit a narrow band of kinetic energies centered on 130 eV/z. After exiting the HDA, ions are focused into an electrostatic linear ion trap where the ions oscillate back and forth through a detector tube. Ions were trapped for 100 ms. The detector tube is connected to a charge sensitive amplifier which detects the induced charge from the oscillating ion. The resulting signal is amplified, digitized, analyzed using fast Fourier transforms. The oscillation frequency provides the m/z and the magnitude of the Fourier transform provides the charge. The mass of each ion is determined from the product of the m/z and charge, and then binned to obtain the mass distribution.

Measurements were performed with hepatitis B virus (HBV) capsid, phage P22 procapsid, cetyltrimethylammonium chloride (CTAC; ≥98% Sigma Aldrich), and polystyrene Beads (41±4 nm Sigma Aldrich). The HBV capsid was assembled from truncated core protein (Cp149) in sodium chloride (300 mM) and transferred into ammonium acetate (100 mM) by size-exclusion chromatography (SEC) (BIO-RAD Micro Bio-Spin™ 30). The HBV capsid is expected to have a peak at ~4 MDa due to the T=4 capsid and a small peak at ~3 MDa due to the T=3 capsid. P22 procapsid was transferred into 100 mM ammonium acetate by SEC. The procapsid is expected to have a peak at around 20 MDa. The CTAC solution was dissolved in water at a concentration of 50 mM. The polystyrene beads were run as received in an aqueous solution with stabilizing surfactant.

Figure 7:
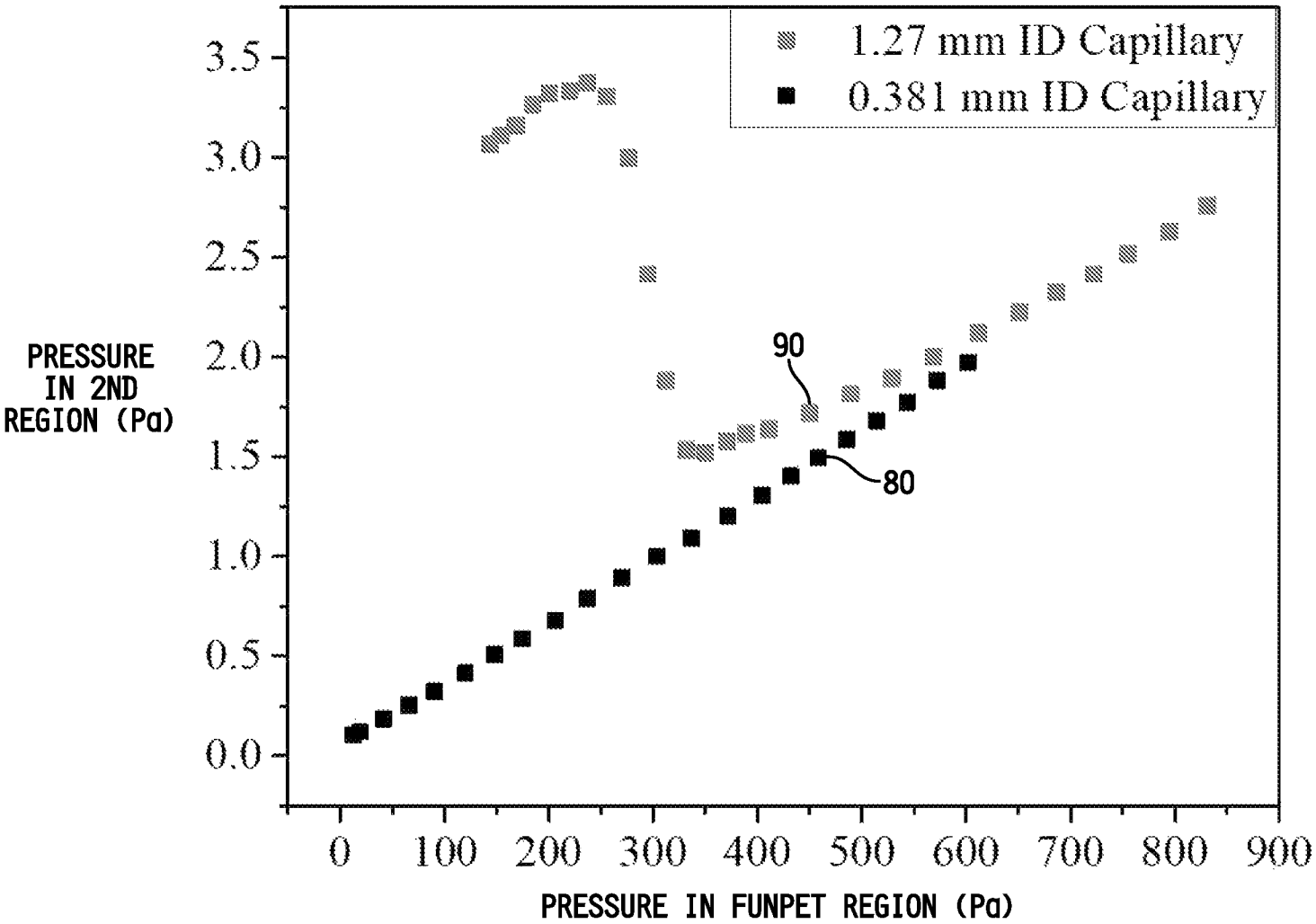
FIG. 7 is a plot of pressure in a differentially pumped region positioned downstream of the FUNPET interface illustrated in FIG. 1B plotted against pressure in the chamber of the FUNPET interface illustrated in FIG. 1B.

Referring now to FIG. 7, performance of the virtual jet disruptor of the FUNPET interface 20 is shown. The ability of the FUNPET interface 20 to transmit a broad mass range is attributed to the disruption of the gas jet by the virtual jet disruptor. This was achieved in the simulations for a capillary with a 0.381 mm ID. To test whether the jet was disrupted as indicated by the simulations, the pressure was monitored in the second differentially pumped region (i.e., the region immediately after the FUNPET) as the pressure in the first region was increased by adding gas through a leak valve. The points 80 in FIG. 7 illustrate the pressure in the second differentially pumped region plotted against the pressure in the chamber housing the FUNPET interface 20. The point closest to the origin is a measurement with no gas added to the FUNPET chamber (i.e., the only gas flow is through the capillary). As the pressure in the FUNPET region is increased, the pressure in the second differentially pumped region increases linearly. This is the behavior for a disrupted jet that does not extend to the FUNPET exit aperture.

To illustrate the behavior of a jet that is not disrupted, the internal diameter of the capillary was increased to 1.27 mm keeping the length at 10 cm. The mass flow rate for this diameter, calculated using the Wutz/Adams turbulent model, is $2.95\times10^{-4}$ kg/s; 26 times that of the 0.381 mm ID capillary. Simulations with this mass flow rate indicated that the jet will not be stopped. The results for this capillary are represented by the points 90 in FIG. 7. Again the point closest to the origin is without gas added to the FUNPET chamber. The pressure in the second differentially pumped region is much higher than with same pressure in the FUNPET chamber with the 0.381 mm ID capillary. This suggests that the jet is not being stopped before the end of the FUNPET interface. As gas is added to the FUNPET chamber the pressure in the second differentially pumped region starts to increase, but then undergoes a sudden drop between 250 and 350 Pa in the FUNPET chamber. As the pressure in the FUNPET chamber is increased further, the pressure in the second differentially pumped chamber increases and gradually approaches the values for the 0.381 ID capillary. The sudden drop in pressure between 250 and 350 Pa in the FUNPET chamber is attributed to the background gas disrupting the gas jet.

These experiments show that with a capillary at the design value of 0.381 mm ID the jet is disrupted by a virtual jet disruptor without the addition of extra gas to increase the background pressure. With a much larger capillary (1.27 mm ID) the drift region is too short to disrupt the jet. The jet can be disrupted by adding gas to the FUNPET chamber to increase the background pressure. However, with the much higher pressure in the FUNPET interface, the gas flow into the second differentially pumped region is much higher and this will cause the excess kinetic energy of the heavier ions to increase significantly.

Figures 8A, 8B, 8C, 8D:
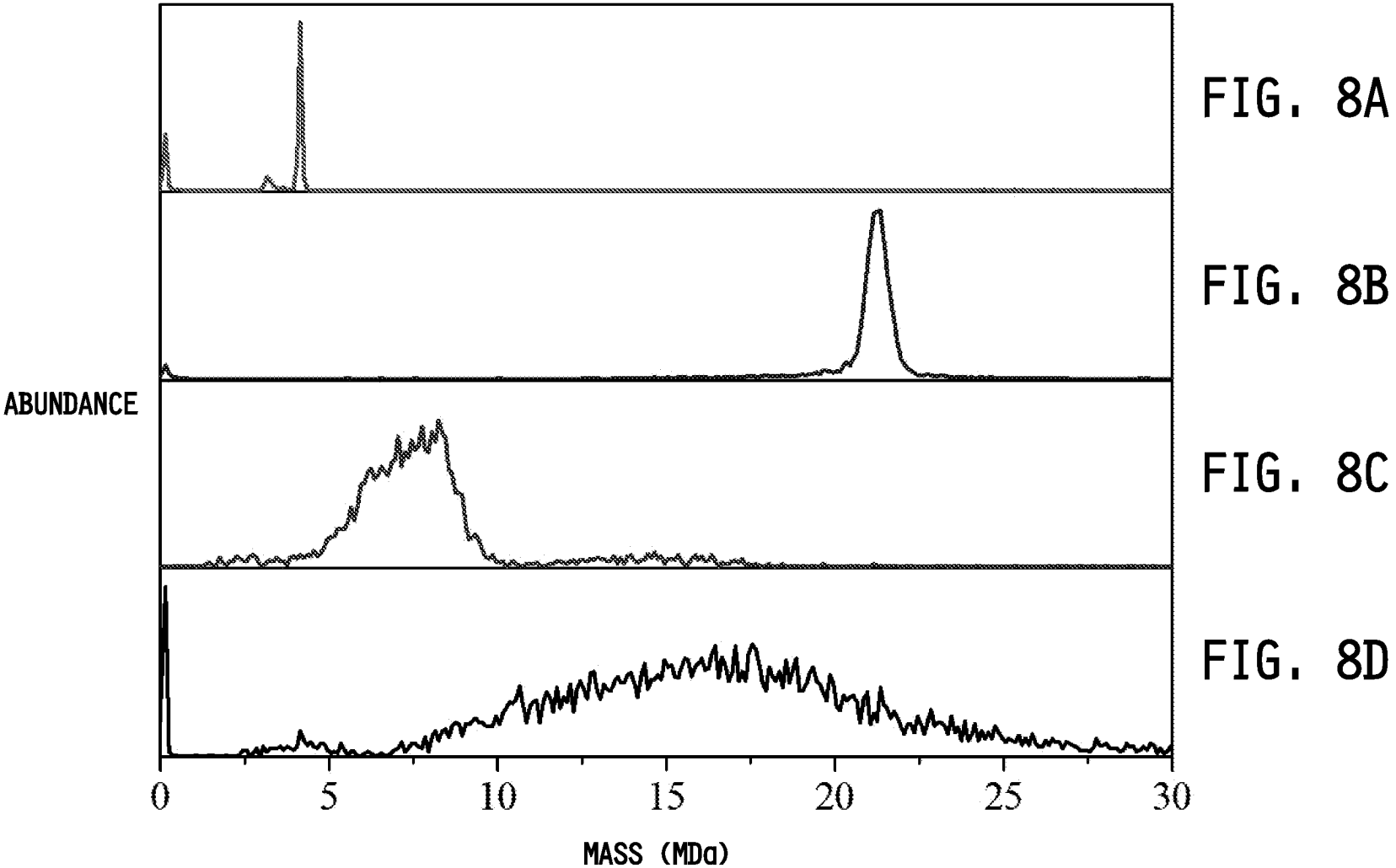
FIGS. 8A-8D illustrate CDMS spectra measured with the FUNPET interface of FIG. 1B for the four analytes: (a) HBV capsid, (b) P22 procapsid, (c) CTAC surfactant, and (d) Polystyrene Beads.

Referring now to FIGS. 8A-8D, CDMS spectra measured for the four analytes are shown. As shown in FIG. 8A, the spectrum for HBV shows an intense peak at ~4.0 MDa due to the T=4 capsid with 120 capsid protein dimers, and a smaller peak at ~3.0 MDa due to the T=3 capsid. FIG. 8B shows that the spectrum for phage P22 procapsid is expected to show a single relatively broad peak between 20 and 30 MDa in agreement with the measured spectrum. The width of the peak is due to the distribution of scaffolding proteins that are present. FIG. 8C shows the spectrum measured for a solution of CTAC where the broad high mass distributions are due to micelles. Finally, FIG. 8D shows the spectrum measured for polystyrene beads (41±4 nm in diameter). The mass distribution from 16.8 MDa to 30.3 MDa is shown in low abundance compared to the surfactant that comprises the majority of the spectrum. The polystyrene sample yet again illustrates the power of the FUNPET to transmit ions in a very broad mass range.

Figure 9A:
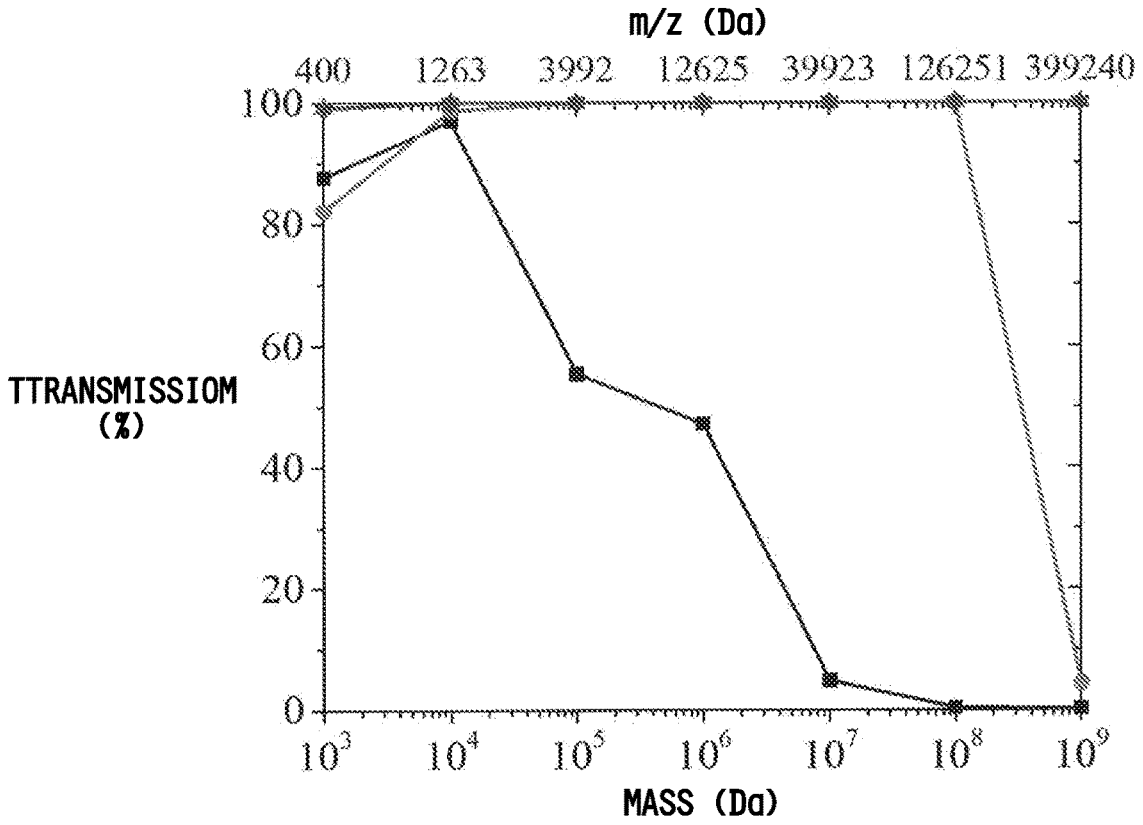
FIGS. 9A and 9B are graphs illustrating ion mass-to-charge ratio (m/z) and mass (Da) plotted against transmission percentage (%) in FIG. 9A or average excess kinetic energy (eV) in FIG. 9B.
Figure 9B:
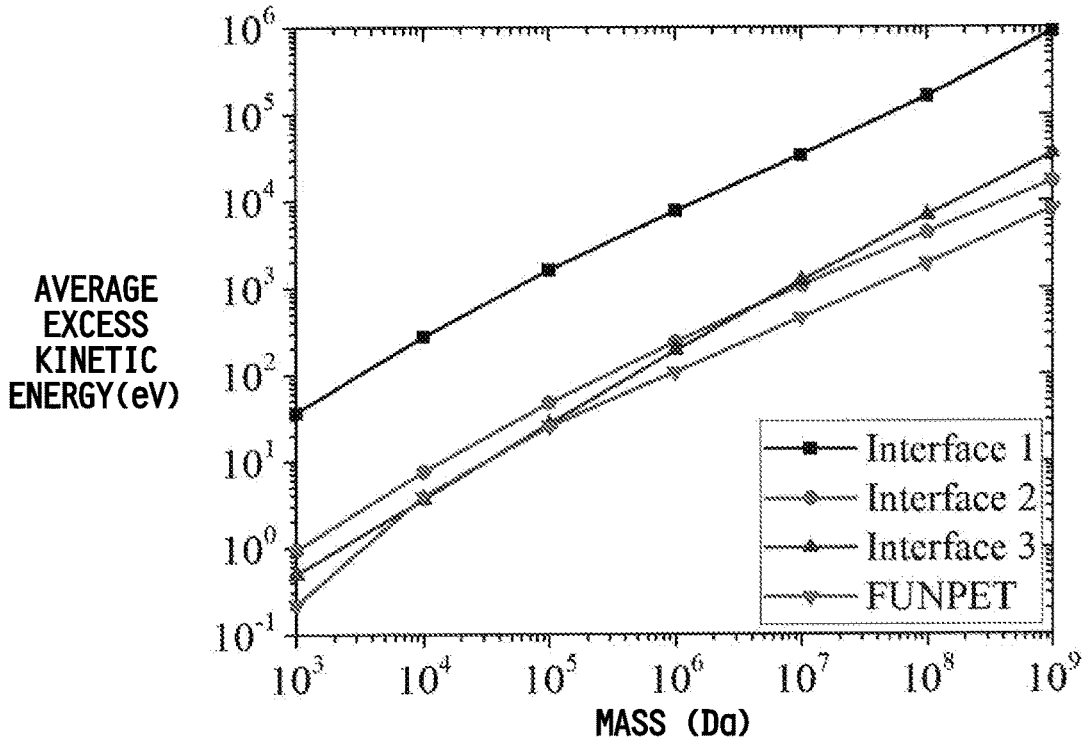

Referring now to FIGS. 9A and 9B, a summary of the ion trajectory simulations is shown for all four interfaces (i.e., Interface 1, Interface 2, Interface 3, and FUNPET Interface). FIG. 9A shows the ion transmission results. High transmission (>85%) is achieved with Interface 1 for only the two lightest masses, 1 and 10 kDa. Transmission is slightly higher for the 10 kDa ions because they are more strongly influenced by the gas flow and the gas flow after the jet returns them closer to the axis. Transmission drops for the heavier ions as they are too energetic to be focused around the ion carpet. Most of the 10 MDa ions crash out on the surface of the jet disruptor.

FIG. 9B shows an average excess kinetic energy of the transmitted ions as a function of ion mass for all four interfaces. Due to the large electric field required on the carpet to focus the ions, the average excess kinetic energy is quite high. The lightest, ions pick up over 35 eV (15 eV/z) from the ion carpet. The largest ions that exit leave with nearly 1 MeV (363 eV/z). As mentioned previously, this broad distribution of ion energies is undesirable. However, the most important conclusion from these simulations is that the jet disruptor is ineffective for large ions because they collide with it. Therefore, an alternative, non-physical method of terminating the gas jet ensures high transmission of all ion masses of interest.

Gas flow simulations show that a physical jet disruptor successfully stops the gas jet from the capillary inlet and transmission is >85% for low mass ions. However, high mass ions crash out on the surface of the jet disruptor. To overcome this problem, a virtual jet disruptor was developed where the drift region is sealed and the resulting pressure build-up and gas counter flow disrupt the gas jet. An ion carpet interface was found to have low transmission for ions that are far off-axis, reducing the transmission of high mass ions. An ion funnel can focus ions that are far off-axis towards the exit aperture; however, the exit aperture needed to be relatively large to avoid ion traps. The large exit aperture led to large excess kinetic energies for high mass ions. The best solution was found by coupling the favorable features of an ion funnel and an ion carpet. In the FUNPET, the ions that are far off-axis are focused by the funnel, but the exit aperture of the funnel is replaced by an ion carpet.

The ion carpet focusses ions through a smaller aperture into the second differentially pumped region. The small aperture reduces the gas load on the second chamber and minimizes the acceleration of high mass ions from the flow passing through the aperture. The performance of the virtual jet disruptor was tested by comparing pressures in the first and second differentially pumped regions for different background pressures and capillary diameters. The operation of the FUNPET was confirmed by performing CDMS measurements on four samples with masses up to around 30 MDa.

Figure 10A:
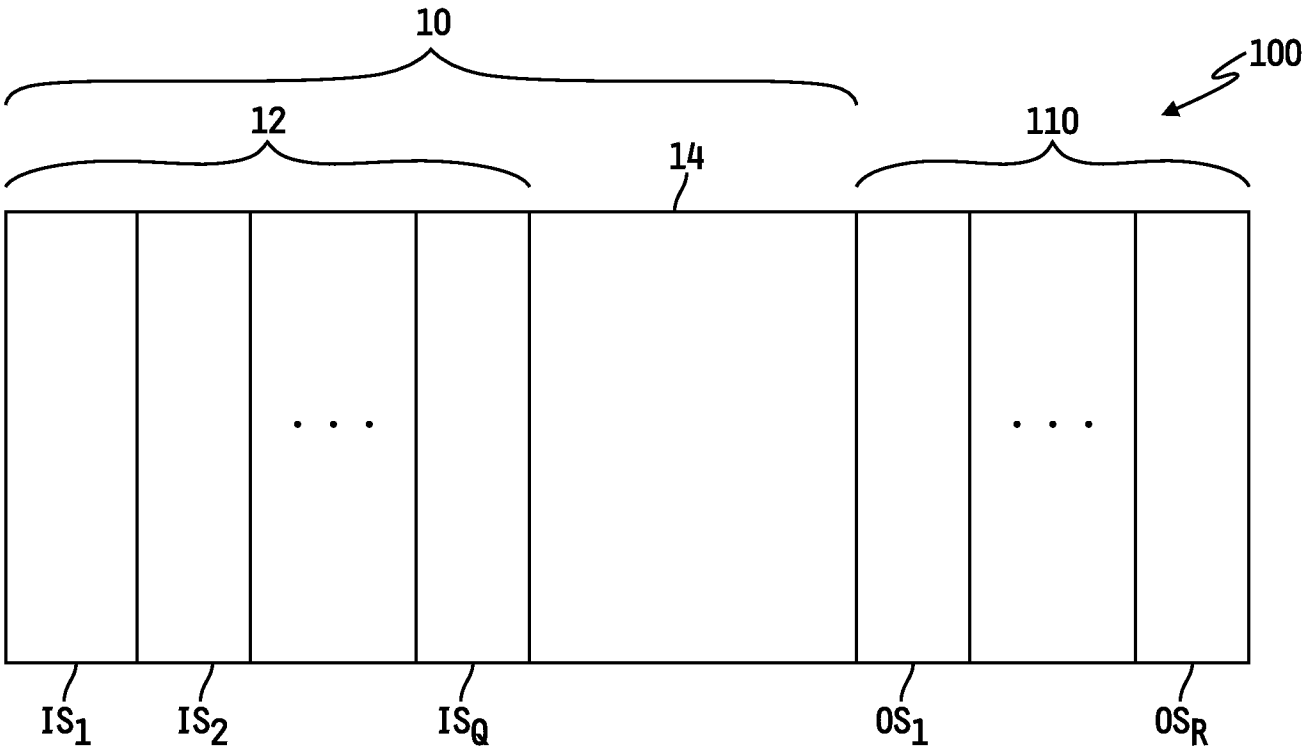
FIG. 10A is a simplified block diagram of an embodiment of an ion separation instrument which may include or incorporate the FUNPET interface illustrated in the figures and described herein along with various example ion processing instruments as part of the ion source upstream of an ELIT, and which may include various example ion processing instruments disposed downstream of the ELIT to further process ion(s) exiting the ELIT.

Referring now to FIGS. 10A and 10A, the FUNPET interface 20 illustrated in FIGS. 1B and 6A-6C and described above, and/or the FUNPET interface 20' illustrated in FIG. 11 and described below, may be used in the ion source 12 of an ion separation instrument 100. Referring to FIG. 10A, a simplified block diagram is shown of an embodiment of the ion separation instrument 100 having an ion source 12 coupled to an electrostatic linear ion trap (ELIT) detector 14 as described above and which may include any number of ion processing instruments in addition to the FUNPET interface 20, 20' described herein, and/or which may include any number of ion processing instruments 110 which may be disposed downstream of the ELIT 14 to further process ion(s) exiting the ELIT 14. In this regard, the ion source 12 is illustrated as including a number, Q, of ion source stages $IS_1$-$IS_Q$ which may be or form part of the ion source 12 and which may include various ion processing instruments in addition to the FUNPET Interface 20, 20' illustrated and described herein. Alternatively or additionally, an ion processing instrument 110 is illustrated in FIG. 10A as being coupled to the ion outlet of the ELIT 14, wherein the ion processing instrument 110 may include any number of ion processing stages $OS_1$-$OS_R$, where R may be any positive integer. In alternate embodiments, the ELIT 14 may be replaced by an orbitrap or other suitable ion detector.

Focusing on the ion source 12, it will be understood that the source 12 of ions entering the ELIT 14 may be or include, in the form of one or more of the ion source stages $IS_1$-$IS_Q$, a conventional ion source, such as the ESI source 18 described herein, in combination with the FUNPET Interface 20, 20' illustrated and described herein, and may further include one or more conventional instruments for separating ions according to one or more molecular characteristics (e.g., according to ion mass, ion mass-to-charge, ion mobility, ion retention time, or the like) and/or one or more conventional ion processing instruments for collecting and/or storing ions (e.g., one or more quadrupole, hexapole and/or other ion traps), for filtering ions (e.g., according to one or more molecular characteristics such as ion mass, ion mass-to-charge, ion mobility, ion retention time and the like), for fragmenting or otherwise dissociating ions, for normalizing or shifting ion charge states, and the like. It will be understood that the ion source 12 may include one or any combination, in any order, of any conventional ion source in combination with the FUNPET interface 20, 20' illustrated and described herein, any ion separation instruments and/or ion processing instruments, and that some embodiments may include multiple adjacent or spaced-apart ones of any such conventional ion sources, ion separation instruments and/or ion processing instruments.

Turning now to the ion processing instrument 110, it will be understood that the instrument 110 may be or include, in the form of one or more of the ion processing stages $OS_1$-$OS_R$, one or more conventional instruments for separating ions according to one or more molecular characteristics (e.g., according to ion mass, ion mass-to-charge, ion mobility, ion retention time, or the like) and/or one or more conventional ion processing instruments for collecting and/or storing ions (e.g., one or more quadrupole, hexapole and/or other ion traps), for filtering ions (e.g., according to one or more molecular characteristics such as ion mass, ion mass-to-charge, ion mobility, ion retention time and the like), for fragmenting or otherwise dissociating ions, for normalizing or shifting ion charge states, and the like. It will be understood that the ion processing instrument 110 may include one or any combination, in any order, of any such conventional ion separation instruments and/or ion processing instruments, and that some embodiments may include multiple adjacent or spaced-apart ones of any such conventional ion separation instruments and/or ion processing instruments. In any implementation which includes one or more mass spectrometers, any one or more such mass spectrometers may be implemented in any of the forms described above with respect to FIG. 1B.

As one specific implementation of the ion separation instrument 100 illustrated in FIG. 10A, which should not be considered to be limiting in any way, the ion source 12 illustratively includes 3 stages, and the ion processing instrument 110 is omitted. In this example implementation, the ion source stage $IS_1$ is a conventional source of ions, e.g., electrospray, MALDI or the like followed by the FUNPET Interface 20, 20' illustrated and described herein, the ion source stage $IS_2$ is a conventional ion filter, e.g., a quadrupole or hexapole ion guide, and the ion source stage $IS_3$ is a mass spectrometer of any of the types described above. In this embodiment, the ion source stage $IS_2$ is controlled in a conventional manner to preselect ions having desired molecular characteristics for analysis by the downstream mass spectrometer, and to pass only such preselected ions to the mass spectrometer, wherein the ions analyzed by the ELIT 14 will be the preselected ions separated by the mass spectrometer according to mass-to-charge ratio. The preselected ions exiting the ion filter may, for example, be ions having a specified ion mass or mass-to-charge ratio, ions having ion masses or ion mass-to-charge ratios above and/or below a specified ion mass or ion mass-to-charge ratio, ions having ion masses or ion mass-to-charge ratios within a specified range of ion mass or ion mass-to-charge ratio, or the like. In some alternate implementations of this example, the ion source stage $IS_2$ may be the mass spectrometer and the ion source stage $IS_3$ may be the ion filter, and the ion filter may be otherwise operable as just described to preselect ions exiting the mass spectrometer which have desired molecular characteristics for analysis by the downstream ELIT 14. In other alternate implementations of this example, the ion source stage $IS_2$ may be the ion filter, and the ion source stage $IS_3$ may include a mass spectrometer followed by another ion filter, wherein the ion filters each operate as just described.

As another specific implementation of the ion separation instrument 100 illustrated in FIG. 10A, which should not be considered to be limiting in any way, the ion source 12 illustratively includes 2 stages, and the ion processing instrument 110 is omitted. In this example implementation, the ion source stage $IS_1$ is a conventional source of ions, e.g., electrospray, MALDI or the like followed by the FUNPET interface 20, 20' illustrated and described herein, the ion source stage $IS_2$ is a conventional mass spectrometer of any of the types described above. In this implementation, the mass spectrometer is operable to separate ions exiting the FUNPET interface 20, 20' according to mass-to-charge ratio, and the ELIT 14 is operable to analyze ions exiting the mass spectrometer. This is the implementation of the CDMS 10 described above with respect to FIGS. 1A-1B in which the FUNPET interface 20, 20' is positioned between an ESI source 18 and a mass spectrometer 22, and the ELIT 14 is operable to analyze ions exiting the mass spectrometer 22.

As yet another specific implementation of the ion separation instrument 100 illustrated in FIG. 10A, which should not be considered to be limiting in any way, the ion source 12 illustratively includes 2 stages, and the ion processing instrument 110 is omitted. In this example implementation, the ion source stage $IS_1$ is a conventional source of ions, e.g., electrospray, MALDI or the like following by the FUNPET interface 20, 20' illustrated and described herein, and the ion processing stage $OS_2$ is a conventional single or multiple-state ion mobility spectrometer. In this implementation, the ion mobility spectrometer is operable to separate ions, exiting the FUNPET interface 20, 20', over time according to one or more functions of ion mobility, and the ELIT 14 is operable to analyze ions exiting the ion mobility spectrometer. In an alternate implementation of this example, the ion source 12 may include only a single stage $IS_1$ in the form of a conventional source of ions followed by the FUNPET interface 20, 20', and the ion processing instrument 110 may include a conventional single or multiple-stage ion mobility spectrometer as a sole stage $OS_1$ (or as stage $OS_1$ of a multiple-stage instrument 110). In this alternate implementation, the ELIT 14 is operable to analyze ions generated by the ion source stage $IS_1$, and the ion mobility spectrometer $OS_1$ is operable to separate ions exiting the ELIT 14 over time according to one or more functions of ion mobility. As another alternate implementation of this example, single or multiple-stage ion mobility spectrometers may follow both the ion source stage $IS_1$ and the ELIT 14. In this alternate implementation, the ion mobility spectrometer following the ion source stage $IS_1$ is operable to separate ions, generated by the ion source stage $IS_1$, over time according to one or more functions of ion mobility, the ELIT 14 is operable to analyze ions exiting the ion source stage ion mobility spectrometer, and the ion mobility spectrometer of the ion processing stage $OS_1$ following the ELIT 14 is operable to separate ions exiting the ELIT 14 over time according to one or more functions of ion mobility. In any implementations of the embodiment described in this paragraph, additional variants may include a mass spectrometer operatively positioned upstream and/or downstream of the single or multiple-stage ion mobility spectrometer in the ion source 12 and/or in the ion processing instrument 110.

As still another specific implementation of the ion separation instrument 100 illustrated in FIG. 10A, which should not be considered to be limiting in any way, the ion source 12 illustratively includes 2 stages, and the ion processing instrument 110 is omitted. In this example implementation, the ion source stage $IS_1$ is a conventional liquid chromatograph, e.g., HPLC or the like configured to separate molecules in solution according to molecule retention time, and the ion source stage $IS_2$ is a conventional source of ions, e.g., electrospray or the like followed by the FUNPET interface 20, 20'. In this implementation, the liquid chromatograph is operable to separate molecular components in solution, the ion source stage $IS_2$ is operable to generate ions from the solution flow exiting the liquid chromatograph, and the ELIT 14 is operable to analyze ions generated by the ion source stage $IS_2$. In an alternate implementation of this example, the ion source stage $IS_1$ may instead be a conventional size-exclusion chromatograph (SEC) operable to separate molecules in solution by size. In another alternate implementation, the ion source stage $IS_1$ may include a conventional liquid chromatograph followed by a conventional SEC or vice versa. In this implementation, ions are generated by the ion source stage $IS_2$ from a twice separated solution; once according to molecule retention time followed by a second according to molecule size, or vice versa. In any implementations of the embodiment described in this paragraph, additional variants may include a mass spectrometer operatively positioned between the ion source stage $IS_2$ and the ELIT 14.

Figure 10B:
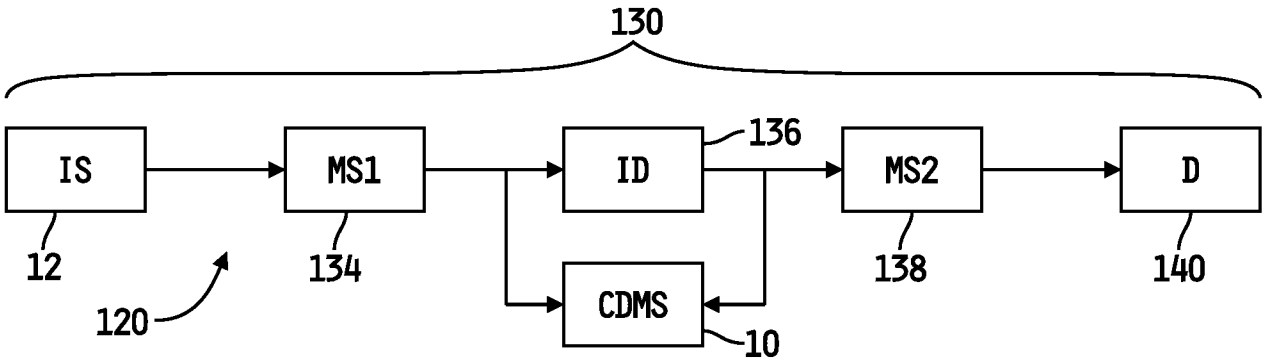
FIG. 10B is a simplified block diagram of an embodiment of an ion separation device which combines conventional ion processing instruments with the ion mass detection system illustrated and described herein including or incorporating the FUNPET interface illustrated in the figures and described herein.

Referring now to FIG. 10B, a simplified block diagram is shown of another embodiment of an ion separation instrument 120 which illustratively includes a multi-stage mass spectrometer instrument 130 and which also includes a CDMS 10 implemented as a high ion mass analysis component. In the illustrated embodiment, the multi-stage mass spectrometer instrument 130 includes an ion source (IS) 12 as described herein, which includes a conventional source of ions such as an electrospray or MALDI source which may be followed by the FUNPET interface 20, 20' illustrated and described herein, followed by and coupled to a first conventional mass spectrometer (MS1) 134, followed by and coupled to a conventional ion dissociation stage (ID) 136 operable to dissociate ions exiting the mass spectrometer 134, e.g., by one or more of collision-induced dissociation (CID), surface-induced dissociation (SID), electron capture dissociation (ECD) and/or photo-induced dissociation (PID) or the like, followed by an coupled to a second conventional mass spectrometer (MS2) 138, followed by a conventional ion detector (D) 140, e.g., such as a microchannel plate detector or other conventional ion detector. The CDMS 10 is as described above with respect to FIGS. 1A and 1B and is coupled in parallel with and to the ion dissociation stage 136 such that the CDMS 10 may selectively receive ions from the mass spectrometer 84 and/or from the ion dissociation stage 136.

MS/MS, e.g., using only the ion separation instrument 130, is a well-established approach where precursor ions of a particular molecular weight are selected by the first mass spectrometer 134 (MS1) based on their m/z value. The mass selected precursor ions are fragmented, e.g., by collision-induced dissociation, surface-induced dissociation, electron capture dissociation or photo-induced dissociation, in the ion dissociation stage 136. The fragment ions are then analyzed by the second mass spectrometer 136 (MS2). Only the m/z values of the precursor and fragment ions are measured in both MS1 and MS2. For high mass ions, the charge states are not resolved and so it is not possible to select precursor ions with a specific molecular weight based on the m/z value alone. However, by coupling the instrument 130 to the CDMS instrument 10 operable as described herein, it is possible to select a narrow range of m/z values and then use the CDMS instrument 10 to determine the masses of the m/z selected precursor ions. The mass spectrometers 134, 138 may be, for example, one or any combination of a magnetic sector mass spectrometer, time-of-flight mass spectrometer or quadrupole mass spectrometer, although in alternate embodiments other mass spectrometer types may be used. In any case, the m/z selected precursor ions with known masses exiting MS1 can be fragmented in the ion dissociation stage 136, and the resulting fragment ions can then be analyzed by MS2 (where only the m/z ratio is measured) and/or by the CDMS instrument 10 (where the m/z ratio and charge are measured simultaneously). Low mass fragments, i.e., dissociated ions of precursor ions having mass values below a threshold mass value, e.g., 10,000 Da (or other mass value), can thus be analyzed by conventional MS, using MS2, while high mass fragments (where the charge states are not resolved), i.e., dissociated ions of precursor ions having mass values at or above the threshold mass value, can be analyzed by CDMS 10.

Figure 11:
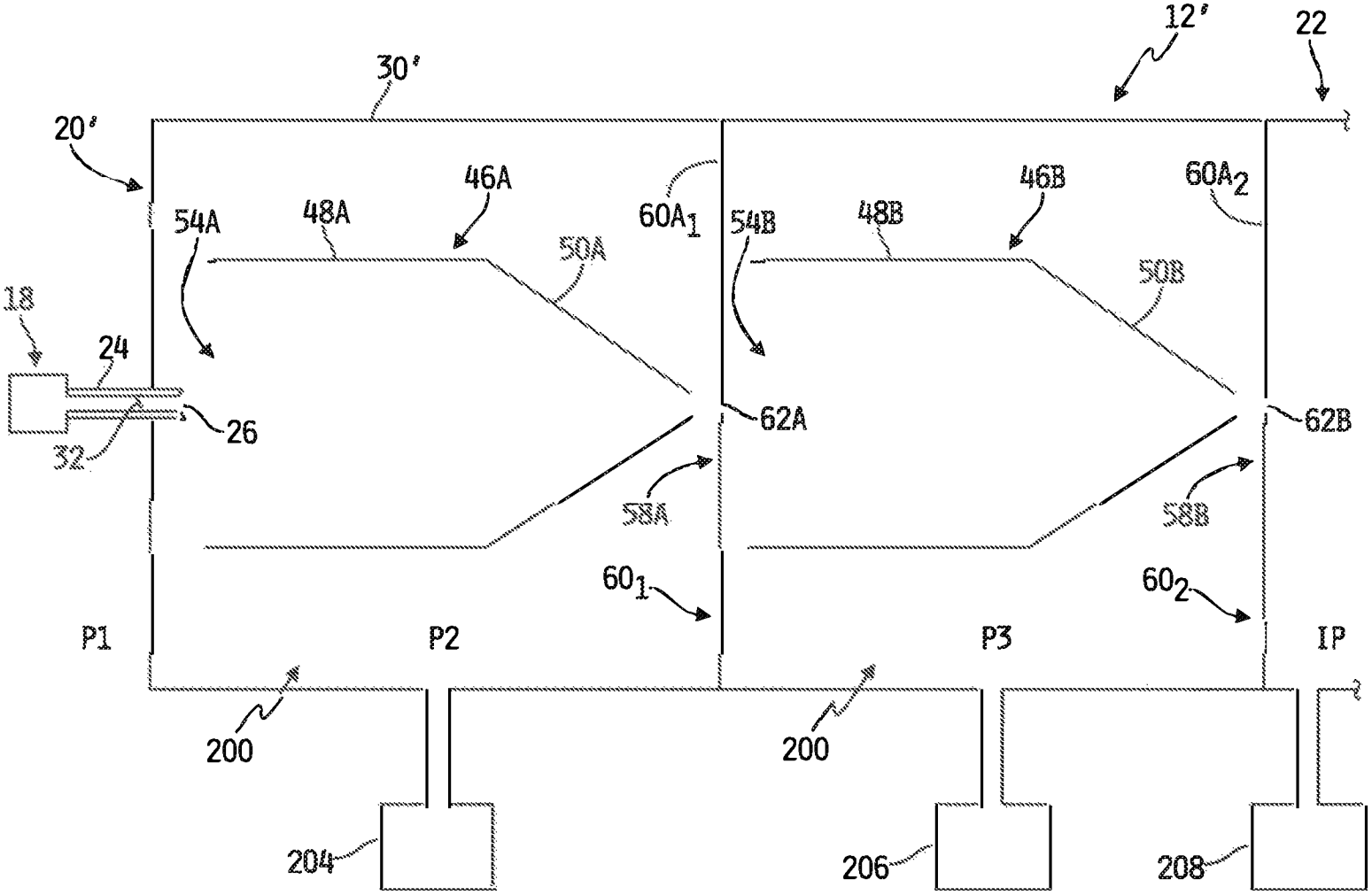
FIG. 11 is a simplified diagram of another embodiment of the ion source of the CDMS of FIG. 1A which includes an embodiment of a multiple-stage hybrid ion funnel-ion carpet (FUNPET) interface operatively positioned between an ion generator and a mass spectrometer.

Referring now to FIG. 11, another embodiment is shown of the ion source 12' illustrated in FIG. 1A. In the embodiment illustrated in FIG. 11, like numbers are used to identify like components, and a detailed description of such components will therefore not be repeated here for brevity. In the embodiment depicted in FIG. 11, for example, the ion source 12' illustratively includes a source of ions 18, i.e., a conventional ion generation device operating at a pressure P1, operatively coupled to an ion inlet of a conventional mass spectrometer or mass analyzer 22 via an ion transport interface 20'. In one embodiment, the source of ions 18 is an ESI source fluidly coupled to a sample solution and disposed in an ambient environment such that P1 is ambient pressure, i.e., approximately 760 torr, although in other embodiments P1 may be any pressure greater than an instrument pressure IP of the mass spectrometer or mass analyzer 22. A capillary 24 of the source 18 extends into an ion inlet 32 of a chamber 30', and an ion outlet 26 at one end of the capillary 24 is positioned within the chamber 30'. The ESI source is operable in a conventional manner to generate ions from the sample, and to produce the generated ions via the ion outlet 26 of the capillary 24.

The chamber 30' illustratively includes a substantially closed region 200 coupled to another substantially closed region 202. A first ion funnel 46A is disposed in the region 200 and a second ion funnel 46B is disposed in the region 202. The Ion funnels 46A, 46B may illustratively be structurally as described above with each having a drift region 48A, 48B respectively having a first open end 54A, 54B and an opposite second end coupled to one end of a tapered funnel region 50A, 50B. The drift regions 48A, 48B each define a respectively axial passageway therethrough, and in some embodiments the axial passageways defined through the drift regions 48A, 48B have constant cross-sectional areas so as to define constant aperture regions. In some such embodiments, the constant cross-sectional areas of the drift regions 48A, 48B are the same, and in other embodiments they may differ. In still other embodiments, the axial passageway 48A and/or 48B may not have a constant cross-sectional area. The funnel regions 50A, 50B likewise each define a respective axial passageway therethrough which taper from a cross-sectional area at the first end thereof coupled to a respective one of the drift regions 48A, 48B to a second end of reduced cross-section. In some embodiments, the cross-sectional areas of the axial passageways of the funnel regions 50A, 50B at the first end thereof are equal to the cross-sectional areas of the drift regions 48A, 48B at the second ends thereof, although in other embodiments either or both such cross sectional areas may not be equal. In the illustrated embodiment, as described above with respect to FIG. 1B, the funnel regions 50A, 50B illustratively taper linearly from the first ends to the opposite second ends thereof, although in other embodiments, the funnel region 50A and/or the funnel region 50B may taper non-linearly or piecewise linearly. In any case, the tapered funnel region 50A of the ion funnel 46A defines a virtual jet disrupter therein, and the tapered region 50B of the ion funnel 46B likewise defines a virtual jet disrupter therein, each as described above.

In some embodiments, the drift regions 46A, 46B and the funnel regions 50A, 50B are formed using axially spaced-apart electrically conductive ring electrodes sized to define the respective axial passageways therethrough as described above, although in other embodiments the drift region 46A, 46B and/or the funnel region 50A, 50B may have alternate construction. In any case, DC and/or time-varying voltages, e.g., RF voltages, may be applied to the drift regions 46A, 46B and the funnel regions 50A, 50B to create ion motive and/or focusing electric fields respective therein as described above.

Each of the regions 200, 202 further includes an ion carpet 58A, 58B respectively, each of which may be structurally as described above, i.e., each defining a plurality of nested concentric electrically conductive strips or regions formed on a respective planar surface $\mathbf{60}A_1$, $\mathbf{60}A_2$ of a respective substrate $\mathbf{60}_1$, $\mathbf{60}_2$ about a respective ion outlet 62A, 62B defined through the respective substrate $\mathbf{60}_1$, $\mathbf{60}_2$. The ion outlet 62A is illustratively aligned, i.e., is collinear with, the ion outlet defined at the second, reduced aperture end of the funnel region 50A of the ion funnel 46A, and the ion outlet 62B is illustratively aligned, i.e., is collinear with, the ion outlet defined at the second, reduced aperture end of the funnel region 50B of the ion funnel 46B. In some embodiments, the ion carpet 58A may be sealed to the second end of the funnel region 50A of the ion funnel 46A and/or the ion carpet 58B may be sealed to the second end of the funnel region 50B of the ion funnel 46B as described above with respect to FIG. 1B. Alternatively, the ion carpet 58A may be separate and axially spaced apart from the second end of the funnel region 50A of the ion funnel 46A and/or the ion carpet 58B may be separate and axially spaced apart from the second end of the funnel region 50B of the ion funnel 46B, each as illustrated by example in FIG. 11. In either case, the substrate $\mathbf{60}_1$ illustratively spans the width and height of the chamber 30' and is sealed to the chamber 30' such that the substantially closed region 200 is defined by three walls of the chamber 30' and by the substrate $\mathbf{60}_1$, with only the ion inlet 32 and the ion outlet 62A forming openings thereto. Likewise, the substrate $\mathbf{60}_2$ illustratively spans the width and height of the chamber 30' and is sealed to the chamber 30' such that the substantially closed region 202 is defined by three walls of the chamber 30' and by the substrate $\mathbf{60}_2$, with only the ion outlets 62A and 62B forming openings thereto. The substrate $\mathbf{60}_1$ thus partitions the interior space of the chamber 30' into the two sequential regions 200, 202, and the substrate $\mathbf{60}_2$ seals the region 202 from the ion inlet portion of the mass spectrometer or mass analyzer 22.

A pump 204 is fluidly coupled to the region 200, and is configured to pump the region 200 to a pressure P2. Another pump 206 is fluidly coupled to the region 202, and is configured to pump the region 202 to a pressure P3. Yet another pump 208 is fluidly coupled to the mass spectrometer or mass analyzer, and is configured to pump the region to the instrument pressure IP. Typically, the instrument pressure IP established and controlled by the pump 208 is within the millitorr range as is conventional, although in some embodiments the instrument pressure IP may be outside of the millitorr range. The pressure P2 established and controlled by the pump 204 will be less than P1 but greater than IP, and the pressure P3 established and controlled by the pump 206 will be less than P2 but greater than IP. In some embodiments, the pressure P2 will illustratively be within the range of tens of torr, with a first non-limiting example being in the range of approximately 30-60 torr and a second non-limiting example being about 50 torr, and the pressure P3 will illustratively be in the range of slightly or somewhat greater than IP and somewhat less than P2, with a first non-limiting example being in the range of approximately something in the millitorr range-10 torr and a second non-limiting example being in the range of approximately 1-3 torr.

The pressure difference between P1 and P2 creates a directed gas flow exiting the capillary 24 in the form of a jet which transports ions generated by the ion source 18 into the inlet 54A of the ion funnel 46A. As described in detail above with respect to FIG. 1B, the ion funnel 46A defines a virtual jet disrupter therein which at least partially dissipates this jet exiting the capillary 24 and which also at least partially thermalizes the ions within the funnel 46A as the ions pass therethrough. As the gas flows deeper into the drift region 48A and funnel region 50A, back pressure develops and increases, which slows the gas flow and eventually creates an area of built-up pressure within the funnel region 50A which causes a counterflow of gas back toward and out of the ion inlet 54A of the ion funnel 46A, as described above. The combination of this area of pressure build-up and the counterflow of gas creates the virtual jet disrupter within the funnel region 50A of the ion funnel 46A which at least partially dissipates the gas flow jet and at least partially thermalizes the ions passing through the ion funnel 46A.

The pressure difference between P2 and P3 likewise creates another directed gas flow exiting the ion carpet 58A in the form of a jet which transports ions exiting the ion funnel 46A and the ion carpet 58A into the inlet 54B of the ion funnel 46B. Like the ion funnel 46A, the ion funnel 46B defines a virtual jet disrupter therein which at least partially dissipates this jet exiting the ion funnel 46A and the ion carpet 58A and which also at least partially thermalizes the ions within the funnel 46B as the ions pass therethrough. As the gas flows deeper into the drift region 48B and funnel region 50B, back pressure develops and increases, which slows the gas flow and eventually creates an area of built-up pressure within the funnel region 50B which causes a counterflow of gas back toward and out of the ion inlet 54B of the ion funnel 46B, as described above. The combination of this area of pressure build-up and the counterflow of gas creates the virtual jet disrupter within the funnel region 50B of the ion funnel 46B which at least partially dissipates this gas flow jet and at least partially thermalizes the ions passing through the ion funnel 46B.

In some embodiments, the multi-stage interface 20' illustrated in FIG. 11 may have a number of advantages over the single-stage design 20 illustrated in FIGS. 1B and 6A-6C. For example, in one example embodiment which should not be considered to be limiting in any way, the ion funnel 46 illustrated in FIGS. 1B and 6A-6C is approximately 15 inches in axial length, and in this example embodiment the pump 42 is illustratively operable to control the pressure within the chamber 30 to a pressure within the range of approximately 10-20 torr. As such, a significant pressure differential exists between the chamber 30 and the mass spectrometer or mass analyzer 22 which results in a correspondingly significantly high flow rate of gas into the mass spectrometer or mass analyzer 22. Moreover, at an axial length of approximately 15 inches, the ion funnel 46 may not be long enough to reduce the flow rate of gas therethrough to a desired level.

In contrast, partitioning the chamber 30' into the two sequential regions 200, 202 in the embodiment of the interface 20' illustrated in FIG. 11 allows the overall pressure differential between the chamber 30' and the mass spectrometer or mass analyzer 20 to be less than that of the interface 20, e.g., by a factor of 10 or more. As a point of comparison, in order for the ion funnel 46 of FIGS. 1B and 6A-6C to reduce the gas flow rate into the mass spectrometer or mass analyzer 22 to that achievable with the interface 20' may require an axial length of the ion funnel 46 of something in the range of 20 feet. Implementation of a multi-stage interface 20' thus allows for a substantial reduction in the overall axial length of the device in contrast to a single-stage interface 20 with comparable operating parameters. Further still, the size and capacity of the pump 42 required to pump the interior of the chamber 30 from approximately 760 torr to 10 torr may, in some embodiments, be prohibitively expensive, whereas the pressure drop demand on each the two pumps 204 and 206 of the embodiment illustrated in FIG. 11 is substantially less, and the sizes and capacities of the pumps 204 and 206 may accordingly be substantially less than that of the pump 42. In some embodiments, the cost of using two pumps 204, 206 may be less than that of the single pump 42.

It will be understood that while the multi-stage interface 20' illustrated in FIG. 11 includes only two sequentially arranged ion funnels 46A, 46B, alternate embodiments may include three or more sequentially arranged ion funnels disposed in three or more corresponding regions of the chamber 30' each pumped to a respectively lower pressure.

It will be understood that the FUNPET interface 20, 20' illustrated described herein may be implemented in an ion source of any CDMS device including at least one electrostatic linear ion trap (ELIT) detector designed to establish a desired duty cycle of ion oscillation therein, corresponding to a ratio of time spent by an ion in a charge detection cylinder thereof and a total time spent by the ion traversing a combination of opposing ion mirrors and the charge detection cylinder during one complete oscillation cycle. For example, a duty cycle of approximately 50% may be desirable for the purpose of reducing noise in fundamental frequency magnitude determinations resulting from harmonic frequency components of the measure signals. Details relating to dimensional and electric field considerations for achieving a desired duty cycle, e.g., such as 50%, are illustrated and described in U.S. Patent Application Ser. No. 62/616,860, filed Jan. 12, 2018, U.S. Patent Application Ser. No. 62/680,343, filed Jun. 4, 2018 and co-pending International Patent Application No. PCT/US2019/013251, filed Jan. 11, 2019, all entitled ELECTROSTATIC LINEAR ION TRAP DESIGN FOR CHARGE DETECTION MASS SPECTROMETRY, the disclosures of which are all expressly incorporated herein by reference in their entireties.

It will be further understood that the FUNPET interface 20, 20' illustrated described herein may be implemented in an ion source of any CDMS device including an electrostatic linear ion trap (ELIT) array having one or more ELITs or ELIT regions. Examples of some such ELITs and/or ELIT arrays are illustrated and described in U.S. Patent Application Ser. No. 62/680,315, filed Jun. 4, 2018 and in co-pending International Patent Application No. PCT/US2019/013283, filed Jan. 11, 2019, both entitled ION TRAP ARRAY FOR HIGH THROUGHPUT CHARGE DETECTION MASS SPECTROMETRY, the disclosures of which are both expressly incorporated herein by reference in their entireties.

It will be further understood that the FUNPET interface 20, 20' illustrated and described herein may be implemented in an ion source of any CDMS device including a detector, e.g., in the form of an ELIT, orbitrap or other detector, in which one or more charge detection optimization techniques are used, e.g., for trigger trapping and/or other charge detection events. Examples of some such charge detection optimization techniques are illustrated and described in U.S. Patent Application Ser. No. 62/680,296, filed Jun. 4, 2018 and in co-pending International Patent Application No. PCT/US2019/013280, filed Jan. 11, 2019, both entitled APPARATUS AND METHOD FOR CAPTURING IONS IN AN ELECTROSTATIC LINEAR ION TRAP, the disclosures of which are both expressly incorporated herein by reference in their entireties.

It will be further understood that the FUNPET interface 20, 20' illustrated and described herein may be implemented in an ion source of any CDMS including a detector, e.g., in the form of an ELIT, orbitrap or other detector, in which one or more charge calibration or resetting apparatuses may be used with at least one charge detection cylinder or electrode. An example of one such charge calibration or resetting apparatus is illustrated and described in U.S. Patent Application Ser. No. 62/680,272, filed Jun. 4, 2018 and in co-pending International Patent Application No. PCT/US2019/013284, filed Jan. 11, 2019, both entitled APPARATUS AND METHOD FOR CALIBRATING OR RESETTING A CHARGE DETECTOR, the disclosures of which are both expressly incorporated herein by reference in their entireties.

It will be still further understood that the FUNPET interface 20, 20' illustrated and described herein may be implemented any CDMS device or system configured to operate in accordance with real-time analysis and/or real-time control techniques, some examples of which are illustrated and described in U.S. Patent Application Ser. No. 62/680,245, filed Jun. 4, 2018 and co-pending International Patent Application No. PCT/US2019/013277, filed Jan. 11, 2019, both entitled CHARGE DETECTION MASS SPECTROMETRY WITH REAL TIME ANALYSIS AND SIGNAL OPTIMIZATION, the disclosures of which are both expressly incorporated herein by reference in their entireties.

It will be still further understood that in any of the systems 10, 100, 130 illustrated in the attached figures and described herein, the ELIT 14 may be replaced with an orbitrap. An example of one such orbitrap is illustrated and described in U.S. Patent Application Ser. No. 62/769,952, filed Nov. 20, 2018 and in co-pending International Patent Application No. PCT/US2019/013278, filed Jan. 11, 2019, both entitled ORBITRAP FOR SINGLE PARTICLE MASS SPECTROMETRY, the disclosures of which are both expressly incorporated herein by reference in their entireties.

It will be yet further understood that the FUNPET interface 20, 20' illustrated and described herein may be implemented any CDMS device or system in which one or more ion inlet trajectory control apparatuses and/or techniques is/are used to provide for simultaneous measurements of multiple individual ions within an ELIT 14. Examples of some such ion inlet trajectory control apparatuses and/or techniques are illustrated and described in U.S. Patent Application Ser. No. 62/774,703, filed Dec. 3, 2018 and in co-pending International Patent Application No. PCT/US2019/013285, filed Jan. 11, 2019, both entitled APPARATUS AND METHOD FOR SIMULTANEOUSLY ANALYZING MULTIPLE IONS WITH AN ELECTROSTATIC LINEAR ION TRAP, the disclosures of which are both expressly incorporated herein by reference in their entireties.

While the disclosure has been illustrated and described in detail in the drawings and foregoing description, such an illustration and description is to be considered as exemplary and not restrictive in character, it being understood that only illustrative embodiments have been shown and described and that all changes and modifications that come within the spirit of this disclosure are desired to be protected. For example, while the various embodiments have been described herein as interfaces for transporting ions from an atmospheric pressure environment to a low pressure environment, it will be understood that such embodiments represent only one or more non-limiting examples, and that the concepts illustrated in the attached figures and described herein are applicable to any instrument, apparatus, device or system in which any of the described interfaces may be implemented to transport ions from a first pressure environment to a second pressure environment in which the first pressure is greater than the second pressure.

What is claimed is:

1. An interface for transporting ions from a first pressure region at a first pressure into an analysis instrument controlled to an instrument pressure that is less than the first pressure, the interface comprising:

a second pressure region, disposed between the first pressure region and the analysis instrument, controlled to a second pressure that is less than the first pressure and greater than the instrument pressure, an ion funnel disposed in the second pressure region and having a plurality of spaced-apart ring electrodes together defining an axial passageway therethrough, wherein the ions enter the axial passageway at a first end of the ion funnel and exit the axial passageway at an exit aperture defined at or adjacent to a second end of the ion funnel, the plurality of ring electrodes sealed together opposite the axial passageway to form a sealed ion funnel, and an ion carpet disposed in the second pressure region and sealed to the ion funnel at the second end of the axial passageway, the ion carpet defining an ion outlet spaced apart from the exit aperture, wherein ions exiting the ion outlet of the ion carpet enter an ion inlet of the analysis instrument, and wherein at least a portion of the axial passageway adjacent to the first end of the ion funnel defines a drift region and at least another portion of the axial passageway between the drift region and the second end of the ion funnel defines a funnel region in which a cross-sectional area of the axial passageway tapers from a first cross-sectional area adjacent to the drift region to a second reduced cross-sectional area at the second end of the axial passageway, the tapered axial passageway of the funnel region defining a virtual jet disrupter therein.

2. The interface of claim 1, wherein the virtual jet disrupter is configured to thermalize the ions passing through the ion funnel.

3. The interface of claim 1, wherein the virtual jet disrupter is created by a combination of a pressure build-up and a gas counter-flow within the sealed ion funnel, the virtual jet disrupter configured to disrupt a gas jet entering the sealed ion funnel from the first end thereof.

4. The interface of claim 1, wherein the ion carpet comprises a planar substrate defining a plurality of nested concentric, electrically conductive rings about the ion outlet on a major planar surface thereof facing the exit aperture of the sealed ion funnel, and further comprising at least one DC voltage source configured to establish an electric field gradient between the plurality of nested concentric, electrically conductive rings, the electric field gradient oriented to guide ions exiting the exit aperture of the ion funnel through the ion outlet of the ion carpet.

5. The interface of claim 4, further comprising at least one RF voltage source configured to apply at least one RF voltage to the plurality of nested, concentric electrically conductive rings to guide ions exiting the exit aperture of the ion funnel through the ion outlet of the ion carpet.

6. The interface of claim 1, wherein the ion carpet is spaced apart from the exit aperture of the ion funnel, and further comprising means for sealing the ion carpet to the second end of the sealed ion funnel.

7. The interface of claim 1, wherein the axial passageway defining the drift region defines a constant cross-sectional area between the first end of the ion funnel and the funnel region.

8. The interface of claim 1, wherein the ions entering the axial passageway of the ion funnel have masses ranging between daltons and megadaltons, and wherein the virtual jet disrupter thermalizes the generated ions such that the thermalized ions exit the ion outlet of the ion carpet with low excess kinetic energy.

9. The interface of claim 1, further comprising:

a third pressure region disposed between the second pressure region and the analysis instrument, the third pressure region controlled to a third pressure that is less than the second pressure and greater than the instrument pressure, wherein the ion funnel is a first ion funnel disposed in the second pressure region, the ion carpet is a first ion carpet disposed in the second pressure region, the ion outlet of the ion funnel is a first ion outlet of the first ion funnel and the virtual jet disrupter is a first virtual jet disrupter, and wherein ions exiting the first ion outlet of the first ion carpet enter an ion inlet of the third pressure region, a second ion funnel disposed in the third pressure region and having a second drift region defining a first end, an opposite second end and a third axial passageway therethrough, and a second funnel region defining a first end coupled to the second end of the second drift region, an opposite second end and a fourth axial passageway therethrough that tapers from a cross-sectional area of the third axial passageway at the first end of the second funnel region to a reduced cross-sectional area at the second end thereof, wherein ions exiting the first ion outlet of the first ion funnel enter the first end of the second drift region and exit at the second end of the second funnel region, and wherein the fourth axial passageway defines a second virtual jet disrupter therein, and a second ion carpet disposed in the third pressure region opposite the second end of the second ion funnel and defining a second ion outlet therethrough, wherein ions exiting the second ion outlet enter the ion inlet of the analysis instrument.

10. The interface of claim 9, wherein a pressure difference between the first pressure the second pressure creates a directed gas flow in the form of a first jet which transports the ions into the first end of the first drift region of the first ion funnel, and wherein the first virtual jet disrupter at least partially dissipates the first jet, and wherein a pressure difference between the second pressure the third pressure creates another directed gas flow in the form of a second jet which transports the ions exiting the first ion funnel into the first end of the second drift region of the second ion funnel, and wherein the second virtual jet disrupter at least partially dissipates the second jet.

11. The interface of claim 9, wherein the ions entering the first drift region of the first ion funnel have masses ranging between daltons and megadaltons, and wherein the first and second virtual jet disrupters thermalize the ions passing through the first and second respective ion funnels such that the thermalized ions exit the second ion outlet of the second ion carpet with low excess kinetic energy.

12. An interface for transporting ions from a first pressure region at a first pressure into an analysis instrument controlled to an instrument pressure that is less than the first pressure, the interface comprising:

a second pressure region, disposed between the first pressure region and the analysis instrument, controlled to a second pressure that is less than the first pressure and greater than the instrument pressure, an ion funnel disposed in the second pressure region and having a plurality of spaced-apart ring electrodes together defining an axial passageway therethrough, the plurality of ring electrodes sealed together opposite the axial passageway to form a sealed ion funnel, wherein a pressure difference between the first pressure and the second pressure creates a directed gas flow which transports the ions into a first end of the axial passageway, and an ion carpet disposed in the second pressure region and sealed to the ion funnel at a second end of the axial passageway opposite the first end thereof, the ion carpet defining an ion outlet spaced apart from an ion exit of the ion funnel defined at or adjacent to the second end of the axial passageway, wherein ions exiting the ion outlet of the ion carpet enter an ion inlet of the analysis instrument, and wherein at least a portion of the axial passageway adjacent to the first end thereof defines a drift region and at least another portion of the axial passageway between the drift region and the second end of the axial passageway defines a funnel region in which a cross-sectional area of the axial passageway tapers from a first cross-sectional area adjacent to the drift region to a second reduced cross-sectional area at the ion exit of the ion funnel, and wherein a combination of pressure build-up and a gas counter-flow within the funnel region creates an area within the funnel region which thermalizes the ions passing through the ion funnel.

13. The interface of claim 12, wherein the directed gas flow forms a supersonic jet which transports the ions into the first end of the axial passageway, and wherein the created area within the funnel region of the ion funnel defines a virtual jet disrupter which dissipates the supersonic jet and thermalizes the ions passing through the ion funnel.

14. The interface of claim 12, wherein the axial passageway defining the drift region defines a constant cross-sectional area between the between the first end of the axial passageway and the funnel region.

15. The interface of claim 12, further comprising:

a third pressure region disposed between the second pressure region and the analysis instrument, the third pressure region controlled to a third pressure that is less than the second pressure and greater than the instrument pressure, wherein the ion funnel is a first ion funnel disposed in the second pressure region, the ion carpet is a first ion carpet disposed in the second pressure region and the ion outlet of the ion funnel is a first ion outlet of the first ion funnel, and wherein ions exiting the first ion outlet of the first ion carpet enter an ion inlet of the third pressure region, a second ion funnel disposed in the third pressure region and having a second drift region defining a first end, an opposite second end and a third axial passageway therethrough, and a second funnel region defining a first end coupled to the second end of the second drift region, an opposite second end and a fourth axial passageway therethrough that tapers from a cross-sectional area of the third axial passageway at the first end of the second funnel region to a reduced cross-sectional area at the second end thereof, wherein ions exiting the first ion outlet of the first ion funnel enter the first end of the second drift region and exit at the second end of the second funnel region, and wherein a pressure difference between the second pressure and the third pressure creates a second directed gas flow which transports the ions exiting the first ion outlet of the first ion funnel into the first end of the third axial passageway, and a second ion carpet disposed in the third pressure region opposite the second end of the second ion funnel and defining a second ion outlet therethrough, wherein ions exiting the second ion outlet enter the ion inlet of the analysis instrument, wherein a combination of pressure build-up and a gas counter-flow within the second funnel region creates an area within the second funnel region which thermalizes the ions passing through the second ion funnel.

16. An interface for transporting ions from first pressure region at a first pressure into an analysis instrument controlled to an instrument pressure that is less than the first pressure, the interface comprising:

a second pressure region, disposed between the first pressure region and the analysis instrument, controlled to a second pressure that is less than the first pressure and greater than the instrument pressure, an ion funnel having a plurality of spaced-apart ring electrodes together defining an axial passageway therethrough, the plurality of ring electrodes sealed together opposite the axial passageway to form a sealed ion funnel, wherein a pressure difference between the first pressure and the second pressure creates a first gas flow which transports the ions into a first end of the axial passageway defining an ion inlet of the ion funnel, and an ion carpet sealed to the ion funnel at a second end of the axial passageway opposite the first end thereof, the ion carpet defining an ion exit, wherein ion exiting the ion exit of the ion carpet enter an ion inlet of the analysis instrument, wherein at least a portion of the axial passageway adjacent to the first end thereof defines a drift region and at least another portion of the axial passageway between the drift region and the second end of the axial passageway defines a funnel region in which a cross-sectional area of the axial passageway tapers from a first cross-sectional area adjacent to the drift region to a second reduced cross-sectional area at the ion exit of the ion funnel, and wherein a cross-sectional area of the ion inlet of the ion funnel is greater than a cross-sectional area of the ion outlet of the ion funnel such that the combination of the sealed ion funnel and the ion carpet sealed to the second end thereof reduces gas flow exiting the ion outlet of the ion funnel from the first gas flow to a second gas flow that is less than the first gas flow.

17. The interface of claim 16, wherein the first gas flow forms a supersonic jet which transports the ions into ion inlet of the ion funnel, and wherein tapered axial passageway of the funnel region defines a virtual jet disrupter therein configured to dissipate the supersonic jet.

18. The interface of claim 16, wherein ions passing through the ion funnel are thermalized by the virtual jet disrupter.

19. The interface of claim 16, wherein the axial passageway defining the drift region defines a constant cross-sectional area between the between the first end of the axial passageway and the funnel region.

20. The interface of claim 16, further comprising:

a third pressure region disposed between the second pressure region and the analysis instrument, the third pressure region controlled to a third pressure that is less than the second pressure and greater than the instrument pressure, wherein the ion funnel is a first ion funnel disposed in the second pressure region, the ion carpet is a first ion carpet disposed in the second pressure region and the ion outlet of the ion funnel is a first ion outlet of the first ion funnel, and wherein ions exiting the first ion outlet of the first ion carpet enter an ion inlet of the third pressure region, a second ion funnel disposed in the third pressure region and having a second drift region defining a first end, an opposite second end and a third axial passageway therethrough, and a second funnel region defining a first end coupled to the second end of the second drift region, an opposite second end and a fourth axial passageway therethrough that tapers from a cross-sectional area of the third axial passageway at the first end of the second funnel region to a reduced cross-sectional area at the second end thereof, wherein a pressure difference between the second pressure and the third pressure creates a second gas flow which transports ions exiting the second pressure region into the first end of the third axial passageway, and a second ion carpet disposed in the third pressure region opposite the second end of the second ion funnel and defining a second ion exit therethrough, wherein ions exiting the second ion exit enter the ion inlet of the analysis instrument, wherein the cross-sectional area of the ion inlet of the first drift region of the first ion funnel is greater than the cross-sectional area of the ion outlet of the first funnel region of the first ion funnel such that the combination of the sealed first ion funnel and the first ion carpet sealed to the second end of the first funnel region reduces gas flow exiting the ion exit of the first ion carpet from the first gas flow to the second gas flow, and wherein a cross-sectional area of the ion inlet of the second drift region of the second ion funnel is greater than a cross-sectional area of the ion outlet of the second funnel region of the second ion funnel such that the combination of the sealed second ion funnel and the second ion carpet sealed to the second end of the second funnel region reduces gas flow exiting the ion exit of the second ion carpet from the second gas flow to a third gas flow that is less than the second gas flow.

* * * * *